US005093228A

United States Patent [19]

Nakamura

[11] Patent Number: 5,093,228

[45] Date of Patent: * Mar. 3, 1992

[54] METHOD FOR PROCESSING SILVER HALIDE COLOR PHOTOGRAPHIC MATERIAL

[75] Inventor: Shigeru Nakamura, Kanagawa, Japan

[73] Assignee: Fuji Photo Film Co., Ltd., Kanagawa, Japan

[ * ] Notice: The portion of the term of this patent subsequent to Oct. 16, 2007 has been disclaimed.

[21] Appl. No.: 389,720

[22] Filed: Aug. 4, 1989

[30] Foreign Application Priority Data

Aug. 5, 1988 [JP] Japan ..... 63-195774

[51] Int. Cl.[5] ..... G03C 7/42

[52] U.S. Cl. ..... 430/393; 430/430; 430/455; 430/460

[58] Field of Search ..... 430/393, 455, 460, 491, 430/430, 434, 467

[56] References Cited

U.S. PATENT DOCUMENTS 4,444,873 4/1984 Ishikawa et al. ..... 430/455
4,797,351 1/1989 Ishikawa et al. ..... 430/491
4,963,474 10/1990 Fujita et al. ..... 430/429

FOREIGN PATENT DOCUMENTS 0330043 8/1989 European Pat. Off. .
62-222252 9/1987 Japan .

OTHER PUBLICATIONS

*Patent Abstracts of Japan*, vol. 12, No. 88, p. 678 (1988) JP-A-222252.
European Search Report, 03/90.

*Primary Examiner*—Hoa Van Le
*Attorney, Agent, or Firm*—Sughrue, Mion, Zinn, Macpeak & Seas

[57] ABSTRACT

A method for processing a silver halide color photographic material is disclosed, comprising the step of:

(a) developing an imagewise exposed silver halide color photographic material, (b) processing the developed silver halide color photographic material with a bath having a bleaching ability, and (c) processing the bleached silver halide color photographic material with a bath having a fixing ability, wherein said bath having a bleaching ability comprises 0.2 mol/liter or more of a (1,3-diaminopropanetetraacetato)iron (III) complex salt and has a pH of from 2.5 to 5.5, and said bath having a fixing ability comprises at least one aminopolycarboxylic acid and an organic phosphonic acid.

15 Claims, No Drawings

METHOD FOR PROCESSING SILVER HALIDE COLOR PHOTOGRAPHIC MATERIAL

FIELD OF THE INVENTION

The present invention relates to a method for processing silver halide color photographic material. More particularly, the present invention relates to a processing method which permits rapid processing but in which processing is stable.

BACKGROUND OF THE INVENTION

Processing of color photographic materials generally comprises color development and desilvering as essential steps. In the color development step, silver halide exposed to light is reduced with a color developing agent to produce silver and, at the same time, the oxidized color developing agent is reacted with a color former (coupler) to form a dye image. In the subsequent desilvering step, the silver produced in the color development step is oxidized with an oxidizing agent called a bleaching agent and then dissolved by a silver ion complexing agent commonly called a fixing agent to thereby provide a dye image only on the color light-sensitive material (i.e., color photographic material or color photosensitive material.

The desilvering step includes two-bath desilvering steps which is effected by using a bleaching bath containing a bleaching agent and a fixing bath containing a fixing agent, and monobath desilvering step which is effected by using a bleach-fixing bath containing both the bleaching agent and fixing agent.

Actual development processing of the color light-sensitive materials further includes various auxiliary steps for maintaining photographic and physical qualities of an image or for improving image storage stability, such as hardening, stopping, stabilization, and washing.

With the recent increase of over-the-counter processing service systems used at small-sized laboratories, it has been keenly demanded to reduce the time required for processing so as to rapidly serve of customers. In particular, a reduction in desilvering time that accounts for the majority of the overall processing time has been strongly desired.

Various improvements, such as a combined use of a bleaching accelerator, have been made in the desilvering step. These have not yet been satisfactory, since an (ethylenediaminetetraacetato)iron (III) complex salt, which is a bleaching agent currently used in a bleaching or bleach-fixing solution, has an essential disadvantage of weak oxidizing power.

On the other hand, bleaching agents known to have strong oxidizing power include potassium ferricyanide, bichromates, ferric chloride, persulfates, and bromates. Each of these bleaching agents, however, involves disadvantages from the viewpoint of environmental conservation, safety on handling, and corrosion of metals, so that they are excluded from wide application in over-the-counter processing.

Of the known improvements, a bleaching solution containing a (1,3-diaminopropanetetraacetato)iron (III) complex salt and having a pH of about 6 as described in the example of JP-A-62-222252 (the term "JP-A" as used herein refers to a "published unexamined Japanese patent application") exhibits higher oxidizing power than the bleaching solution containing an (ethylenediaminetetraacetato)iron (III) complex salt, making it feasible to conduct silver bleaching more rapidly.

It is also known in the art (i.e., JP-A-62-222252) that the optimum pH level of a bleaching solution containing an aminopolycarboxylic acid iron (III) complex salt is around 6 from the consideration of a balance between assurance of a bleaching speed and prevention of poor color restoration of a cyan dye. That is, from the fact that a reduction of pH brings about an increase of bleaching speed but, in turn, induces poor color restoration of a cyan dye, a pH of about 6 has been regarded to be the optimum level and thus widely employed in the art.

A (1,3-diaminopropanetetraacetato)iron (III) complex salt has the problem that since they are strongly oxidizing, if a bleaching solution containing them is carried over into the subsequent fixing bath, it reacts with components in the fixing bath and causes fluctuation in the fixing solution's performance.

More specifically, in cases where a thiosulfate is used as a fixing agent, it is necessary to add a sulfite in order to inhibit production of sulfur through decomposition of the thiosulfate, but a (1,3-diaminopropanetetraacetato)iron (III) complex salt having a strongly oxidizing power reacts rapidly with this sulfite. As a result, the thiosulfate is liable to be converted to sulfur and the sulfur produced gives rise to the problem that it constitutes a hindrance by adhering to the film, etc. This problem becomes even greater if the amount of the (1,3-diaminopropanetetraacetato)iron (III) complex salt is increased in order to speed up processing.

SUMMARY OF THE INVENTION

An object of the present invention is to provide a method in which a bleaching treatment is effected rapidly and a bleaching bath has an excellent bleaching ability, and in which deterioration in the solution having a fixing ability due to carry-over of bleaching solution is prevented.

The above object is achieved by a method for processing a silver halide color photographic material comprising the step of:

(a) developing an imagewise exposed silver halide color photographic material, (b) processing the developed silver halide color photographic material with a bleaching bath, and (c) processing the bleached silver halide core photographic material with a bath having a fixing ability, wherein said bleaching bath comprises 0.2 mol/liter or more of a (1,3-diaminopropanetetraacetato)iron (III) complex salt and has a pH of from 2.5 to 5.5, and said bath having a fixing ability comprises at least one aminopolycarboxylic acid and an organic phosphonic acid.

DETAILED DESCRIPTION OF THE INVENTION

In the present invention, a processing solution in a processing bath having a fixing ability includes a fixing solution (including a fixing solution in which a previous bleaching solution which is carried over by a photographic material is mixed), a bleach-fixing solution (including a solution substantially having a bleaching ability containing an aminopolycarboxylic acid iron (III) complex salt which is salt-substituted by an aminopolycarboxylic acid of the present invention in a fixing solution in which a (1,3-diaminopropanetetraacetato)iron (III) complex salt is introduced).

The bath having a fixing ability may be plural baths such as a fixing-fixing and a bleach-fixing-fixing). When it is plural baths, the excellent effects of the present invention can be obtained by adding an aminopolycarboxylic acid or an organic phosphonic acid of the present invention to a bath having a fixing ability immediately after the bleaching bath.

The aminopolycarboxylic acid and organic phosphonic acid used in the present invention can be any such acid and serve effectively as long as it is one which removes Fe (III) ions from the (1,3-diaminopropanetetraacetato)iron (III) complex salt carried over from the preceding bleaching bath and itself forms a more weakly oxidizing, stable Fe (III) complex. This results in considerable inhibition of oxidative degradation due to the Fe (III) complex of fixing solution components that are easily subjected to oxidative degradation, e.g., sulfite ions, thiosulfate ions, etc., and the stability of the solution having a fixing ability is improved. The improvement in the stability makes possible a considerable reduction in the amount of replenisher of the solution having a fixing ability.

Aminopolycarboxylic acids employable in the present invention can be represented by formula (I).

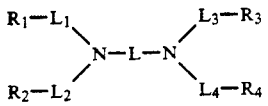

(I)

wherein L represents an ethylene group, a cycloalkylene group, $—C_2H_4—O—C_2H_4—$ or $—C_2H_4—Z—C_2H_4—$ in which Z represents

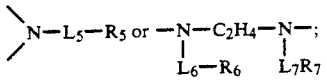

$L_1$ to $L_7$ represent alkylene groups having 1 or 2 carbon atoms; $R_1$ to $R_7$ represent hydrogen atoms, hydroxyl groups, carboxylic acid groups or salts thereof.

The number of carboxylic acid groups contained in formula (I) is generally at least 3, preferably 3 to 7 and more preferably 3 to 5.

Preferred specific examples of compounds represented by formula (I) are illustrated below.

A-(1): Ethylenediaminetetraacetic acid
A-(2): Diethylenetriaminepentaacetic acid
A-(3): Cyclohexylenediaminetetraacetic acid
A-(4): Glycol ether diaminetetraacetic acid
A-(5): Triethylenetetraminehexaacetic acid
A-(6): Hydroxyethylethylenediaminetriacetic acid As long as it is an organic phosphonic acid such as alkylphosphonic acid, phosphonocarboxylic acid or aminopolyphosphonic acid, any such acid may be employed as the organic phosphonic acid that is used in the present invention. In particular, an alkylphosphonic acid or aminopolyphosphonic acid is preferred. The acids are represented by the following formulae (II) to (X).

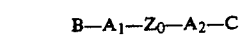

(II)

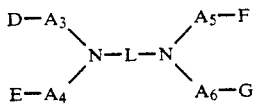

(III)

In formulae (II) and (III), $A_1$ to $A_6$ represent substituted or unsubstituted alkylene groups having 1 to 3 carbon atoms, $Z_0$ represents an alkylene group having 1 to 3 carbon atoms, a cyclohexane group, a phenylene group, —R—O—R, —ROROR—,

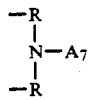

(wherein R is an alkylene group having 1 to 3 carbon atoms) or $<N—A_7$ (wherein $A_7$ is hydrogen, or a hydrocarbon having 1 to 3 carbon atoms, a lower aliphatic carboxylic acid having 1 to 3 carbon atoms or a lower alcohol having 1 to 3 carbon atoms), B, D, E, F and G represent —OH, —COOM or $—PO_3M_2$ (wherein M is hydrogen, an alkali metal or ammonium), at least one of B, C, D, E, F and G is $—PO_3M_2$, and L represents the same meaning as L in formula (I).

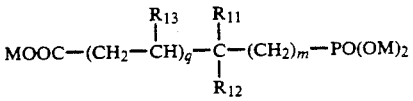

(IV)

$R_{11}$: —COOM or $—PO(OM)_2$
$R_{12}$: hydrogen, an alkyl group having 1 to 4 carbon atoms, $—(CH_2)_n—COOM$, or a phenyl group
$R_{13}$: hydrogen or —COOM
M: hydrogen, an alkali metal or ammonium
m: 0 or 1
n: an integer of from 1 to 4
q: 0 or 1
provided that when m=0, $R_{11}=—PO(OM)_2$.

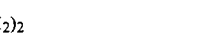

(V)

$R_{14}$: lower alkyl group having 1 to 6 carbon atoms, aryl group having 1 to 6 carbon atoms, aralkyl group having 1 to 6 carbon atoms, nitrogen-containing 6-membered ring group [preferably having —OH, $—OR_{15}$ ($R_{15}$ an alkyl group having 1 to 4 carbon atoms), $—PO_3M_2$, $—CH_2PO_3M_2$, $—N(CH_2PO_3M_2)_2$, $—COOM_2$, $—N(CH_2COOM_2)$ as substituent groups]
M: hydrogen, an alkali metal, ammonium.

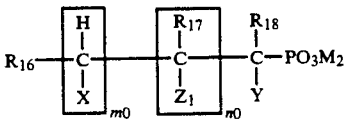

(VI)

$R_{16}$, $R_{17}$ hydrogen, lower alkyl group having 1 to 3 carbon atoms, —COOH or $NJ_2$ (wherein J is H, —OH, a lower alkyl group having 1 to 3 carbon atoms or $C_2H_4OH$)

$R_{18}$: hydrogen, lower alkyl group having 1 to 3 carbon atoms, —OH, $—NL'_2$ (wherein L' is H, —OH, $—CH_3$, $—C_2H_5$, $—C_2H_4OH$ or $—PO_3M_2$)

X, Y, $Z_1$: —OH, —COOM, —$PO_3M_2$ or H
M: hydrogen, an alkali metal, ammonium
$n_0$: 0 or an integer of 1 or more
$m_0$: 0 or 1.

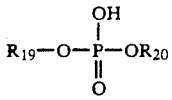
(VII)

$R_{19}$, $R_{20}$: hydrogen, an alkali metal, ammonium, a substituted or unsubstituted alkyl, alkenyl or cyclic alkyl group, having 1 to 12 carbon atoms.

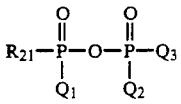
(VIII)

$R_{21}$: an alkyl group having 1 to 12 carbon atoms, an alkoxy group having 1 to 12 carbon atoms, a monoalkylamino group having 1 to 12 carbon atoms, a dialkylamino group having 2 to 12 carbon atoms, an amino group, an allyloxy group having 1 to 24 carbon atoms, an arylamino group or an amyloxy group having 6 to 24 carbon atoms $Q_1$ to $Q_3$: —OH, alkoxy, aralkyloxy or allyloxy groups having 1 to 24 carbon atoms, —$OM_3$ (wherein $M_3$ is a cation), amino groups, morpholino groups, cyclic amino groups, alkylamino groups, dialkylamino groups, arylamino groups or alkyloxy groups.

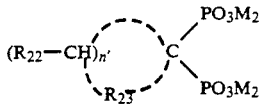
(IX)

$R_{22}$, $R_{23}$: hydrogen, a lower alkyl group having 1 to 6 carbon atoms, imine (may be substituted by a lower alkyl group or —$CH_2CH_2COONa$)
M: hydrogen, an alkali metal, ammonium
n': integer of from 2 to 16.

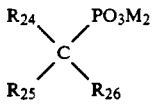
(X)

$R_{24}$ to $R_{26}$: hydrogen, alkyl groups having 1 to 6 carbon atoms [may have —OH, —$OC_{n''}H_{2n\Delta+1}$ (n'':1 to 4), —$PO_3M_2$, —$CH_2PO_3M$, —$NR'_2$ (wherein R' is an alkyl group having 1 to 6 carbon atoms), —$N(CH_2PO_3M_2)_2$]
M: hydrogen, an alkali metal, ammonium.
Compounds represented by formulae (III) and (VI) among these formulae are preferred.
The following may be listed as specific examples of compounds represented by formulae (II) to (X).

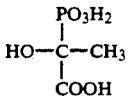
B-(1)

-continued

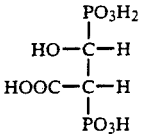
B-(2)

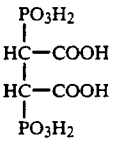
B-(3)

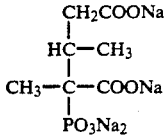
B-(4)

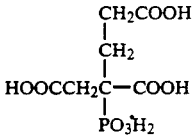
B-(5)

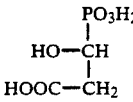
B-(6)

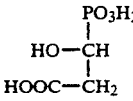
B-(7)

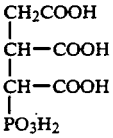
B-(8)

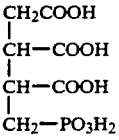
B-(9)

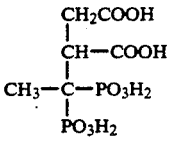
B-(10)

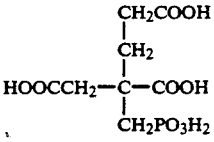
B-(11)

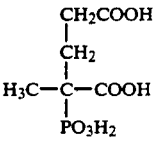
B-(12)

-continued
B-(13)
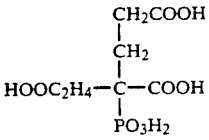
B-(14)
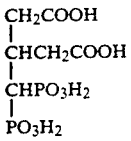
B-(15)
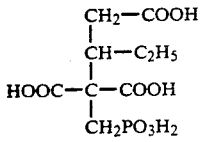
B-(16)
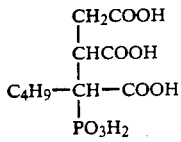
B-(17)
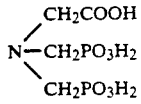
B-(18)
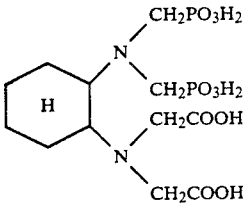
B-(19)
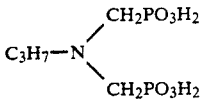
B-(20)
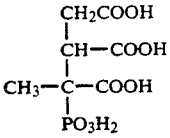
B-(21)
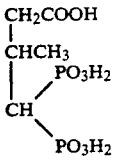
B-(22)
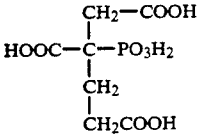
B-(23)
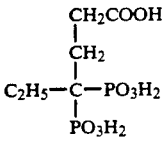
-continued
B-(24)
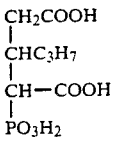
B-(25)
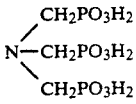
B-(26)
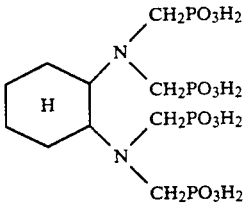
B-(27)
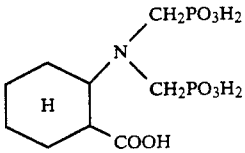
B-(28)
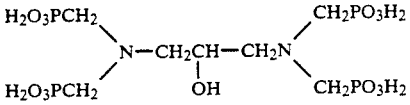
B-(29)
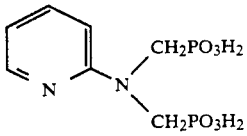
B-(30)
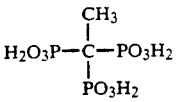
B-(31)
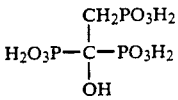
B-(32)
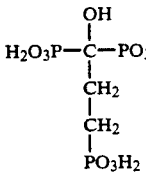
B-(33)
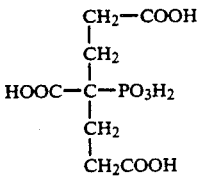
B-(34)
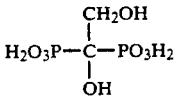

-continued
B-(35)
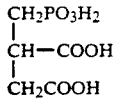
B-(36)
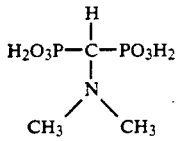
B-(37)
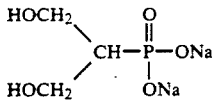
B-(38)
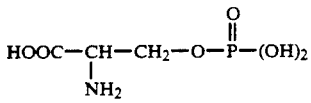
B-(39)
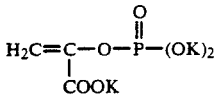
B-(40)
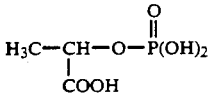
B-(41)
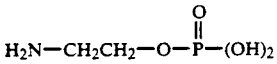
B-(42)
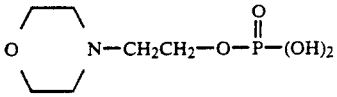
B-(43)
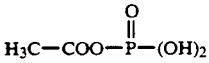
B-(44)
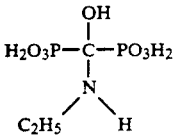
B-(45)
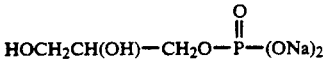
B-(46)
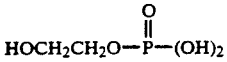
B-(47)
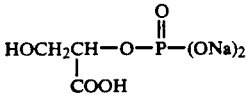
B-(48)
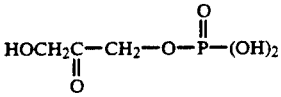
B-(49)
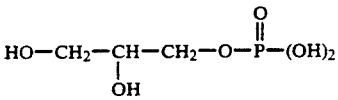
-continued
B-(50)
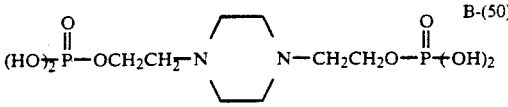
B-(51)
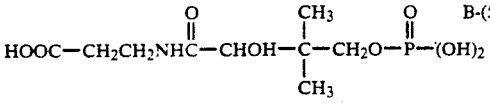
B-(52)
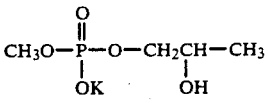
B-(53)
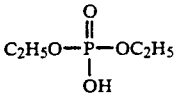
B-(54)
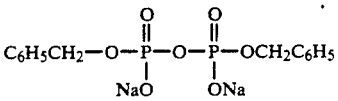
B-(55)
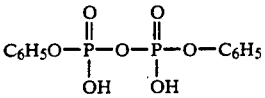
B-(56)
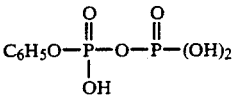
B-(57)
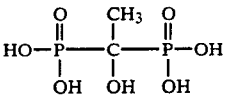
B-(58)
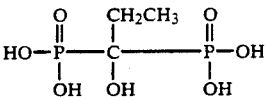
B-(59)
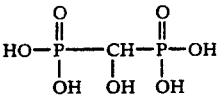
B-(60)
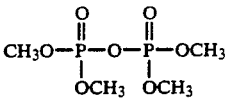
B-(61)
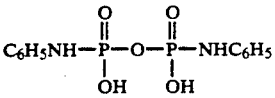
B-(62)
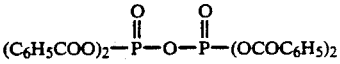
B-(63)
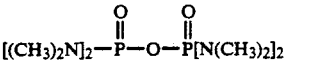
B-(64)
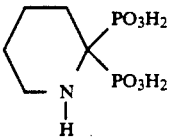

-continued

B-(65)

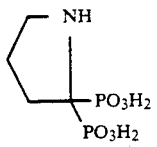

B-(66)

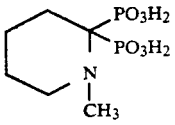

B-(67)

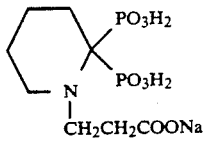

B-(68)

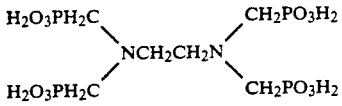

The amount of the polycarboxylic acid and/or organic phosphonic acid that is included in the solution having a fixing ability in the present invention is the amount that is needed to produce a concentration permitting removal of Fe (III) from the (1,3-diaminopropanetetraacetato)Fe (III) complex salt introduced into the solution having a fixing ability. This tepends on the ability of various compounds and Fe (III) to form complexes but it is generally from 1 time to 100 times, preferably from 2 times to 100 times and more preferably from 2 to 30 times the molar quantity of the 1,3-diaminopropanetetraacetic acid carried over from the preceding bleaching bath.

Under conditions of normal use, this is generally $2\times10^{-3}$ mol to 0.2 mol and is preferably $4\times10^{-3}$ mol to 0.1 mol per 1 liter of the solution having a fixing ability.

The bleaching solution to be used in the present invention contains a (1,3-diaminopropanetetraacetato)iron (III) complex salt in an amount of not less than 0.2 mol/liter. Preferred for speeding up processing is a concentration of 0.25 mol/liter or more, and particularly 0.3 mol/liter or more. It should be noted, however, that an excessive concentration of the (1,3-diaminopropanetetraacetato)iron (III) complex salt results in inhibition of bleach. The upper limit is 0.5 mol/liter accordingly. Concentrations of less than 0.2 mol/liter cause not only abrupt retardation of bleach but increased stain after processing. The lower limit of 0.2 mol/liter is therefore an essential condition in the present invention.

The (1,3-diaminopropanetetraacetato)iron (III) complex salt can be used in the form of a salt with ammonium, sodium, potassium, with the ammonium salt being the most preferred for accomplishing rapid bleach.

In the present invention, the pH of the bleaching solution is 5.5 or less, thus surprisingly produce excellent effects while achieving both rapid desilvering and complete color restoration of a cyan dye. The bleaching solution to be used in the present invention has a pH of from 2.5 to 5.5, preferably from 2.5 to 4.5 and more preferably from 2.5 to 3.5. Adjustment of pH to this range can be effected with organic acids, e.g., acetic acid, citric acid, and malonic acid, or inorganic acids, e.g., hydrochloric acid, sulfuric acid, nitric acid, and phosphoric acid. For obtaining a buffer action within the above-recited range, acids having an acid dissociation constant (pKa) ranging from 2.5 to 5.5 are preferred. Such acids include acetic acid, citric acid, and malonic acid as enumerated above, as well as various organic acids, e.g., benzoic acid, formic acid, butyric acid, malic acid, tartaric acid, oxalic acid, propionic acid, and phthalic acid. Particularly preferred of them is acetic acid.

The acid is preferably used in an amount of generally from 0.1 to 2 mols and more preferably from 0.5 to 1.5 mols, per liter of the bleaching solution.

It is desirable to use 1,3-diaminopropanetetraacetic acid in a slight excess over the theoretical amount necessary to form a complex with an iron (III) ion, preferably in a 1 to 10 mol% excess.

The bleaching solution may further contain other aminopolycarboxylic acid iron (III) complex salts than the (1,3-diaminopropanetetraacetato)iron (III) complex salt in combination. For example, iron (III) complex salts of ethylenediaminetetraacetic acid, diethylenetriaminepentaacetic acid and cyclohexanediaminetetraacetic acid can be employed.

The bleaching solution can contain various bleaching accelerators. Examples of useful bleaching accelerators are compounds having a mercapto or disulfide group as described in U.S. Pat. No. 3,893,858, West German Patent 1,290,812, British Patent 1,138,842, JP-A-53-95630, and *Research Disclosure*, No. 17129 (July, 1978); thiazolidine derivatives as described in JP-A-50-140129; thiourea derivatives as described in U.S. Pat. No. 3,706,561; iodides as described in JP-A-58-16235; polyethylene oxides as described in West German Patent 2,748,430; and polyamine compounds as described in JP-B-45-8836. Preferred among them are mercapto compounds as described in British Patent 1,138,842. An amount of the bleaching accelerators used in the present invention is generally from $1\times10^{-4}$ to $2\times10^{-2}$ mol/liter and preferably from $2\times10^{-4}$ to $1\times10^{-2}$ mol/liter based on the bleaching solution.

In addition to the above-described bleaching agents and other additives, the bleaching solution can further contain rehalogenating agents including bromides (e.g., potassium bromide, sodium bromide, ammonium bromide) and chlorides (e.g., potassium chloride, sodium chloride, and ammonium chloride). The rehalogenating agent is usually used in a concentration of from 0.1 to 5 mols and preferably from 0.5 to 3 mols, per liter of the bleaching solution.

It is also advantageous to use ammonium nitrate as a metal corrosion inhibitor in the bleaching solution. An amount of the metal corrosion inhibitor used in the present invention is generally from 0.1 to 1.5 mol/liter and preferably from 0.2 to 1.2 mol/liter based on the bleaching solution.

The bleaching bath of the present invention is usually replenished at a rate of from 50 to 2,000 ml and preferably from 100 to 1,000 ml, per $m^2$ of the light-sensitive material.

In carrying out the processing, it is preferable to subject the bleaching solution to aeration to oxidize the (1,3-diaminopropanetetraacetato)iron (II) complex salt produced by the processing.

After or simultaneously with the bleach processing, the light-sensitive material is subjected to fixing. Fixing agents which can be used include thiosulfates, e.g., sodium thiosulfate, ammonium thiosulfate, sodium ammonium thiosulfate, and potassium thiosulfate; thiocyanates, e.g., sodium thiocyanate, ammonium thiocyanate, and potassium thiocyanate; thiourea; and thioethers, with ammonium thiosulfate being preferred. The amount of the fixing agent to be used is from 0.3 to 3 mols and preferably from 0.5 to 2 mols, per liter of the solution having a fixing ability.

From the standpoint of fixing acceleration, it is also preferable to use ammonium thiocyanate, thiourea, a thioether (e.g., 3,6-dithia-1,8-octanediol),

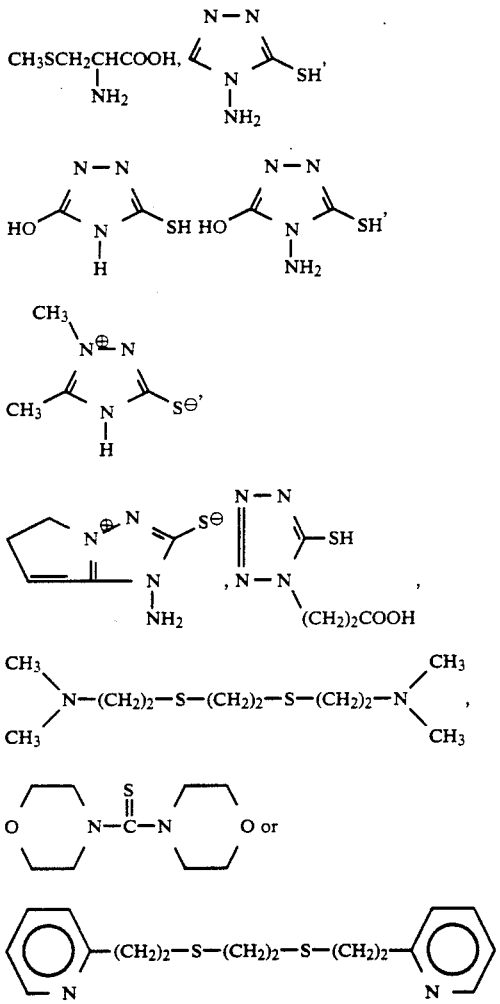

in combination with ammonium thiosulfate. These compounds are usually used in an amount of from about 0.01 to 0.1 mol per liter of the solution having a fixing ability. In some cases, use of from 1 to 3 mols/liter greatly improves fixing acceleration.

The solution having a fixing ability can contain preservatives, such as sulfites (e.g., sodium sulfite, potassium sulfite, ammonium sulfite), hydroxylamine, hydrazine, and bisulfite adductive compounds of aldehyde compounds (e.g., sodium aldehyde bisulfite). It can further contain brightening agents, defoaming agents, surface active agents, polyvinylpyrrolidone, and organic solvents (e.g., methanol). It is particularly preferable to use a sulfinic acid compound as disclosed in JP-A-62-143048 as a preservative.

The bleach-fixing solution can contain the bleaching component and the fixing component as described above. As the bleaching agent, an aminopolycarboxylic acid iron (III) complex salt represented by formula (I) is preferred.

The amount of a replenished solution having a fixing ability preferably ranges from 300 to 3,000 ml, more preferably from 300 to 1,000 ml, and most preferably from 300 to 500 ml, per $m^2$ of the light-sensitive material.

The benefits of the present invention become more pronounced as the total time of desilvering becomes shorter. A preferred desilvering time is from 1 to 4 minutes and more preferably from 1 minute and 30 seconds to 3 minutes. The processing temperature is generally from 25° C. to 50° C. and preferably from 35° C. to 45° C. The desilvering being carried out within the preferred temperature range, the rate of desilvering increases, and stain formation after the processing can be effectively prevented.

For assuring the benefits of the present invention, it is favorable that the desilvering be carried out under enhanced stirring to a high degree as possible. Enhanced stirring can be exercised by a method of striking a jet stream of a processing solution against the emulsion surface of the light-sensitive material as described in JP-A-62-183460 and JP-A-62-183461, a method using a rotating means to heighten the stirring effect as described in JP-A-62-183461, a method in which the light-sensitive material is moved with its emulsion surface being in contact with a wire blade placed in a processing solution so that a turbulent flow is produced on the emulsion surface to improve the stirring effect, and a method of increasing the total circulatory flow of a processing solution. These means for enhanced stirring are effectively applicable to any of the bleaching solution, bleach-fixing solution, and fixing solution. Enhanced stirring is believed to accelerate the supply of the bleaching agent or fixing agent to the emulsion surface, thereby increasing the rate of desilvering.

The above-described means for enhanced stirring is especially effective in case of using a bleaching accelerator. In this case, the acceleration effect can be markedly heightened or the unfavorable effect of the bleaching accelerator on inhibition of fixing can be eliminated.

An automatic developing machine which can be used in the present invention preferably has a means for carrying the light-sensitive material as disclosed in JP-A-60-191257, JP-A-60-191258 and JP-A-60-191259. As illustrated in JP-A-60-191257, such a carrier means considerably reduces carry-over of a processing solution into the succeeding bath to effectively prevent deterioration of the processing solution. This is especially advantageous for reduction of processing time in each step or reduction of replenishment rate.

The present invention produces remarkable advantages when the overall processing time (i.e., all the time from which only the drying time is excluded) is short. More specifically, appreciable effects are obtained when the overall processing time is within 8 minutes, and a marked difference from the conventional processing methods is produced when the overall processing time is within 7 minutes. Accordingly, the processing of the present invention is preferably carried out within 8 minutes and more preferably within 7 minutes.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl—N-(β-hydroxyethyl)amino]aniline
D- 5: 2-Methyl-4-[N-ethyl-N-(β-hydroxyethyl-)amino]aniline
D- 6: 4-Amino-3-methyl-N-ethyl-N-[β-(methanesulfonamino)ethyl]aniline
D- 7: N-(2-Amino-5-diethylaminophenylethyl)methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives, D-5 is particularly preferred.

These p-phenylenediamine derivatives may be in the form of salts such as sulfates, hydrochlorides, sulfites, or p-toluenesulfonates.

The aromatic primary amine developing agent is preferably used in an amount of generally from about 0.1 g to about 20 g and more preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

The color developing solution contains the preservative in an amount of 0.5 g to 10 g and more preferably 1 g to 5 g per liter of the color developing solution.

Further, it is preferred to add, as compounds capable of directly preserving the color developing agent, various hydroxylamines, hydroxamic acids as described in JP-A-63-43138, hydrazines and hydrazides as described in European Patent 254280A, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above-described compounds, monoamines as described in JP-A-63-4235, JP-A-63-24254, JP-A-63-21647, JP-A-63-146040, JP-A-63-27841 and JP-A-63-25654; diamine as described in JP-A-63-30845, JP-A-63-146040 and JP-A-63-43139; polyamines as described in JP-A-63-21647 and JP-A-63-26655; polyamines as described in JP-A-63-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc., may be incorporated into the color developing solution, if desired. Particularly, the addition of aromatic polyhydroxy compounds is preferred.

The color developing solution used in the present invention has a pH which ranges preferably from 9 to 12 and more preferably from 9 to 11.0. The color developing solution may also contain any of the compounds that are known to be usable as components of conventional developing solutions.

In order to maintain the pH within the above-described range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N,-tetramethylenephosphonic acid
Trans-cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-

37-16088, JP-B-37-5987, JP-B-38-7826, JP-B-44-12380, JP-B-45-9019 (the term "JP-B" as used herein refers to an " examined Japanese patent publication") and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926; and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g, per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 seconds to 5 minutes and preferably from 30 seconds to 3 minutes. Further, the amount of replenishment for the color developing solution is preferably as small as feasible, and is usually from 100 ml to 1,500 ml, preferably from 100 ml to 800 ml, and more preferably from 100 ml to 400 ml, per square meter of the color light-sensitive material.

If required, the color developing bath may be divided into two or more baths, so that a color developing replenisher may be supplied from the first bath or the last bath to shorten the developing time or to reduce the amount of the replenisher.

The processing method according to the present invention can be used in a color reversal process. A suitable black-and-white developing solution used in this case includes a black-and-white first developing solution (used in reversal process of color photographic light-sensitive materials), or one that can be used in processing black-and-white photographic light-sensitive materials. Further, known various additives that are generally added to a black-and-white developing solution can be contained in the solution.

Representative additives include developing agents such as 1-phenyl-3-pyrazolidone, Metol ($HOC_6H_4NHCH_3.\frac{1}{2}H_2SO_4$) and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; hard water softening agents such as polyphosphates; and development restrainers comprising trace amounts of iodides or mercapto compounds.

The processing method according to the present invention comprises processing steps including color development, bleaching, bleach-fixing, fixing, etc., as mentioned above. After the bleach-fixing or fixing step, although processing steps that include water washing and stabilizing are generally carried out, a simple processing method is also possible wherein after being processed in a bath having a fixing ability, a stabilizing process is carried out without performing substantial water washing.

The washing water used in the water washing step can contain, if desired, known additives. For example, hard water softening agents such as inorganic phosphoric acid, aminopolycarboxylic acids and organic phosphoric acids, antibacterial and antifungal agents for preventing various bacteria and algae from proliferating (e.g., isothiazolone, organic chlorine type disinfectants and benzotriazole) and surface active agents for lowering drying load or for preventing uneven drying can be used. Compounds described, for example, in L. E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds containing metals such as Bi and Al, fluorescent brightening agents, chelating agents (e.g., 1-hydroxyethylidene-1,1-diphosphonic acid), anti-bacterial, antifungal agents, hardening agents, surface active agents, etc.

It is preferred to employ a multistage countercurrent system in the water washing step or stabilizing step. Two to four stages are preferably used. The amount of replenishment is from 1 to 50 times, preferably from 2 to 30 times and more preferably from 2 to 15 times the amount of processing solution carried over from the preceding bath per a unit area of the color light-sensitive material.

Water suitable for use in the water washing step or the stabilizing step includes city (tap) water, water that has been deionized, for example, by ion exchange resins to reduce Ca and Mg concentrations to 5 mg/liter or below, or water that has been sterilized, for example, by a halogen lamp or a bactericidal ultraviolet lamp.

When continuous processing is performed using an automatic developing machine, concentration of the processing solution tends to occur by evaporation in each step of the processing of color light-sensitive materials. This phenomenon particularly occurs in a case wherein a small amount of color light-sensitive materials is processed or wherein an open area of the processing solution is large. In order to compensate for such concentration of processing solution, it is preferred to replenish them with an appropriate amount of water or a correcting solution.

A technique of introducing an overflow from the water washing or stabilizing step into the prebath of the bath having fixing ability serves to reduce the amount of waste liquor.

The light-sensitive materials to be processed according to the present invention may be those which comprise a support having provided thereon at least one -. of blue-sensitive silver halide emulsion layer, green-sensitive silver halide emulsion layer and red-sensitive silver halide emulsion layer, and are not particularly limited as to the number and the order of silver halide emulsion layers and light-insensitive layers. A typical silver halide photographic material comprises a support having provided thereon at least one light-sensitive layer composed of plural silver halide emulsion layers having substantially the same color sensitivity but having different sensitivities, said light-sensitive layer being a unit light-sensitive layer having color sensitivity to any of blue light, green light and red light. In multilayered silver halide color photographic materials, the unit light-sensitive layers are provided in the order of red-sensitive layer, green-sensitive layer and blue-sensitive layer from the support side. However, reverse order may be employed depending upon intended purpose, or an order wherein a layer having different light sensitivity is sandwiched between layers having the same color sensitivity may be employed.

Various light-insensitive layers such as interlayers may be provided between the silver halide light-sensitive layers or as an uppermost or lowermost layer.

The interlayer may contain couplers, DIR compounds, etc., as described in JP-A-61-43748, JP-A-59-113438, JP-A-59-113440, JP-A-61-20037 and JP-A-61-20038, and color mixing preventing agents used commonly Plural silver halide emulsion layers constituting each unit light-sensitive layer preferably have a two-layer structure of high speed emulsion layer and slow speed emulsion layer as described in West German Patent 1,121,470 or British Patent 923,045. Usually, they are disposed in such order that the sensitivity decreases towards the support. A light-insensitive layer may be provided between the silver halide emulsion layers. In addition, the slow speed emulsion layer may be provided at a position further the support, and the high speed emulsion layer may be provided at a position nearer the support as described in JP-A-57-112751, JP-A-62-200350, JP-A-62-206541 and JP-A-62-206543.

As specific examples, the layers may be provided in the order, from the further side of the support, a slow speed blue-sensitive layer (BL)/a high speed blue-sensitive layer (BH)/a high speed green-sensitive layer (GH)/a slow speed green-sensitive layer (GL)/a high speed red-sensitive layer (RH)/a slow speed red-sensitive layer (RL), or in the order of BH/BL/GL/GH/RH/RL or in the order of BH/BL/GH/GL/RL/RH.

As described in JP-B-55-34932, it is also possible to provide in the order of blue-sensitive layer/GH/RH/GL/RL from the furthest side of the support. In addition, as is described in JP-A-56-25738 and JP-A-62-63936, an order of blue-sensitive layer/GL/RL/GH/RH from the furthest side of the support may be employed.

As is described in JP-B-49-15495, an order wherein three layers having different sensitivities are arranged in such order that sensitivity is decreased towards the support, i.e., an order of a silver halide emulsion layer having the highest sensitivity (top layer), a silver halide emulsion layer having a middle sensitivity (middle layer), and a silver halide emulsion layer having the lowest sensitivity (bottom layer) may also be employed. In this case, too, the three layers with the same color sensitivity may be disposed in the order of a medium speed emulsion layer having middle sensitivity/a high speed emulsion layer having the highest sensitivity/a slow speed emulsion layer having the lowest sensitivity as described in JP-A-59-202464.

As is described above, various layer structures and orders of the layers may be selected according to the purpose of each of light-sensitive materials.

Silver halide preferably incorporated in the photographic emulsion layers of the photographic light-sensitive material of the present invention is silver bromoiodide, silver chloroiodide or silver chlorobromoiodide having a silver iodide content of about 30 mol% or less. Particularly preferable silver halide is silver bromoiodide or silver chlorobromoiodide having a silver iodide content of from about 2 mol% to about 25 mol%.

Silver halide grains in the photographic emulsion may have a regular crystal form such as cubic, octahedral or tetradecahedral form, an irregular form such as spherical or plate form, a form with crystal defect such as twin plane, or a composite form thereof.

With respect to the grain size of silver halide grains, both fine grains of not larger than about 0.2 μm and large sized grains of up to about 10 μm in projected area diameter may be used. The emulsion may be a polydispersed emulsion or a monodispersed emulsion.

The silver halide photographic emulsion to be used in the present invention may be prepared according to processes described in, for example, *Research Disclosure* (*RD*), No. 17643 (December, 1978), pp. 22 and 23, *I. Emulsion Preparation and Types* and ibid., No. 18716 (November, 1979), p. 648, P. Glafkides, *Chimie et Physique Photographique,* Paul Montel (1967), G. F. Duffin, *Photographic Emulsion Chemistry,* Focal Press (1966), V. L. Zelikman et al., *Making and Coating Photographic Emulsion,* Focal Press (1964), etc.

Monodispersed emulsions described in U.S. Pat. Nos. 3,574,628 and 3,655,394 and British Patent 1,413,748 are also preferred.

Tabular grains having an aspect ratio of from about 5 or more can also be used in the present invention. Such tabular grains may be easily prepared according to processes described in Gutoff, *Photographic Science and Engineering,* Vol. 14, pp. 248 to 257 (1970), U.S. Pat. Nos. 4,434,226, 4,414,310, 4,433,048, 4,439,520 and British Patent 2,112,157.

Crystal structure may be a uniform structure, a structure wherein the inner portion and the outer portion are different from each other in halide composition, or a layered structure, or silver halide crystals different from each other may be conjugated to each other by epitaxial conjunction or, further, crystals conjugated to other compounds than silver halide such as silver rhodanine or lead oxide may be used. In addition, a mixture of grains of various crystal forms may also be used.

The silver halide emulsions to be used in the present invention are usually subjected to physical ripening, chemical ripening, and spectral sensitization before use. Additives to be used in these steps are described in *Research Disclosure,* Nos. 17643 and 18716. Places where such additives are described are shown in the table to be shown hereinafter.

Known photographic additives to be used in the present invention are also described in the above-described two Research Disclosure numbers, and places where they are described are also shown in the following table.

| Additives | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizing Agents and Supersensitizing Agents | Pages 23–24 | Page 648, right column to page 649, right column |
| 4. Brightening Agents | Page 24 | — |
| 5. Antifoggants and Stabilizers | Pages 24–25 | Page 649, right column |
| 6. Light Absorbents, Filter Dyes, and UV Ray Absorbents | Pages 25–26 | Page 649, right column to page 650, left column |
| 7. Antistaining Agents | Page 25, right column | Page 650, left to right columns |
| 8. Dye Image Stabilizers | Page 25 | — |
| 9. Hardeners | Page 26 | Page 651, left column |
| 10. Binders | Page 26 | " |
| 11. Plasticizers and Lubricants | Page 27 | Page 650, right column |
| 12. Coating Aids and Surfactants | Pages 26–27 | " |
| 13. Antistatic Agents | Page 27 | " |

Further, in order to prevent the deterioration of photographic properties, compounds which can be fixed with the formaldehydes as described in U.S. Pat. Nos. 4,411,987 and 4,435,503 are preferably added to the light-sensitive material of the present invention.

Various color couplers may be used in the present invention, and specific examples thereof are described in the patents described in the foregoing *Research Disclosure* (*RD*), No. 17643, VII-C to G.

As yellow couplers, those described in, for example, U.S. Pat. Nos. 3,933,501, 4,022,620, 4,326,024, 4,248,961, 3,973,968, 4,314,023, 4,511,649, and 4,401,752, JP-B-58-10739, British Patents 1,425,020 and 1,476,760, European Patent 249,473A, etc., are described.

As magenta couplers, 5-pyrazolone type and pyrazoloazole type compounds are preferred, with those described in U.S. Pat. Nos. 4,310,619, 4,351,897, European Patent 73,636, U.S. Pat. Nos. 3,061,432, 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, U.S. Pat. Nos. 4,500,630, 4,556,630 and 4,540,654, WO (PCT) 88/04795, etc., being particularly preferable.

As cyan couplers, there are illustrated phenolic and naphtholic couplers, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German (OLS) 3,329,729, European Patents 121,365A and 249,453A, U.S. Pat. Nos. 3,446,622, 4,333,999, 4,753,871, 4,451,559, 4,427,767, 4,690,889, 4,254,212, 4,296,199, JP-A-61-42658, etc., are preferred.

As colored couplers for correcting unnecessary absorption of colored dyes, those which are described in *Research Disclosure,* No. 17643, Item VII-G, U.S. Pat. No. 4,163,670, JP-B-57-39413, U.S. Pat. Nos. 4,004,929 and 4,138,258, British Patent 1,146,368, etc., are preferable.

As couplers capable of forming colored dyes with a suitable diffusibility, those which are described in U.S. Pat. No. 4,366,237, British Patent 2,125,570, European Patent 96,570, and West German Patent (OLS) 3,234,533 are preferred.

Typical examples of polymerized dye-forming couplers are described in U.S. Pat. Nos. 3,451,820, 4,080,211, 4,367,282, 4,409,320, 4,576,910 and British Patent 2,102,173.

Couplers capable of releasing a photographically useful residue upon coupling reaction are also preferably used in the present invention. As DIR couplers capable of releasing a development inhibitor, those which are described in patents described in the foregoing *RD,* No. 17643, Item VII-F, JP-A-57-151944, JP-A-57-154234, JP-A-60-184248, JP-A-63-37346, and U.S. Pat. No. 4,248,962 are preferred.

As couplers capable of imagewise releasing a nucleating agent or a development accelerator upon development, those which are described in British Patents 2,097,140 and 2,131,188, JP-A-59-157638 and JP-A-59-170840 are preferred.

As further couplers to be used in the light-sensitive material of the present invention, there are illustrated competitive couplers described in U.S. Pat. No. 4,130,427, etc., poly-equivalent couplers described in U.S. Pat. Nos. 4,283,472, 4,338,393, 4,310,618, etc., DIR redox compound-releasing couplers, DIR coupler-releasing couplers, DIR coupler-releasing redox compounds or DIR redox-releasing redox compounds described in JP-A-60-185950 and JP-A-62-24252, couplers capable of being subjected to color restoration after being released described in European Patent 173,302A, bleaching accelerator-releasing couplers described in *RD,* Nos. 11449 and 24241, JP-A-61-201247, liquid-releasing couplers described in U.S. Pat. No. 4,553,477, leuco pigment-releasing couplers described in JP-A-63-75747, and the like.

The couplers to be used in the present invention may be introduced into light-sensitive materials by various known dispersing methods.

Examples of high boiling organic solvents to be used in an oil-in-water dispersion method are described, e.g., in U.S. Pat. No. 2,322,027.

Specific examples of the high boiling organic solvent having a boiling point of 175° C. or higher at normal pressure which can be used in the water-in-oil dispersion process include phthalic ester (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate), benzoic esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl tosylate), aniline derivatives (e.g., N,N-dibutyl-2-butoxy-5-t-octylaniline), and hydrocarbons (e.g., paraffin, dodecylbenzene, diisopropylnaphthalene). The high boiling organic solvents may be used in combination with auxiliary solvents, such as organic solvents having a boiling point of about 30° C. or more and preferably of from 50° C. to about 160° C. (e.g., ethyl acetate, butyl acetate, ethyl propionate, methyl ethyl ketone, cyclohexanone, 2-ethoxyethyl acetate, dimethylformamide).

Details of a latex dispersion method, its effects, and impregnating latexes suitable for use therein are disclosed, e.g., in U.S. Pat. No. 4,199,363, and West German Patents (OLS) 2,541,274 and 2,541,230.

The present invention is applicable to various types of color light-sensitive materials, typically including color negative films for general use or for movies, color reversal films for slides or TV, color papers, color positive films, and color reversal papers.

Supports which can be used in the present invention are described, e.g., in *Research Disclosure*, No. 17643, p. 28, ibid., 18716, p. 647, right column to p. 648, left column.

In the light-sensitive materials of the present invention, hydrophilic colloidal layers on the emulsion layer side preferably have a total film thickness of not more than 28 μm and a rate of swelling ($T_{\frac{1}{2}}$) of not more than 30 seconds. The terminology "film thickness" as used herein means the thickness as measured after conditioning at 25° C. and 55% RH for 2 days. The terminology "rate of swelling" as used herein means the time required for the film thickness to reach half the saturated film thickness, the saturated film thickness being defined as 90% of the maximum swollen film thickness reached when a light-sensitive material is processed in a color developing solution at 30° C. for 3 minutes and 15 seconds. The rate of swelling $T_{\frac{1}{2}}$ can be measured according to technique known in the art. For example, it can be measured with a swelling meter of the type described in A. Green et al., *Phot. Sci. Eng.*, Vol. 19, No. 2, pp. 124 to 129.

The rate of swelling $T_{\frac{1}{2}}$can be controlled by addition of a hardening agent to gelatin to be used as a binder or by alteration of conditions after coating. The degree of swelling preferably ranges from 150 to 400%. The terminology "degree of swelling" as used herein means the percentage of an increase of thickness (maximum swollen film thickness—initial film thickness) to initial film thickness.

The present invention is now illustrated in greater detail with reference to the following Examples, but the present invention is not to be construed as being limited thereto. Unless otherwise indicated, all parts, percents and ratios are by weight.

EXAMPLE 1

A multilayer color light-sensitive material (Sample 101) having an undercoated triacetyl cellulose film support having provided thereon the layers shown below was prepared.

Regarding the amount of the respective components as coated, the silver halide and colloidal silver are represented by the units of g/m² as silver coated; the coupler, additives and gelatin are represented by the units of g/m²; and the sensitizing dye is represented by the number of mols per mol of the silver halide in the same layer.

Abbreviations used in the compositions shown have the following meanings:

UV: Ultraviolet absorbent
Solv: High boiling organic solvent
ExF: Dye
ExS: Sensitizing dye
ExC: Cyan coupler
ExM: Magenta coupler
ExY: Yellow coupler
Cpd: Additive
H: Hardening agent

| | |
|---|---|
| 1st Layer: Antihalation Layer: | |
| Black Colloidal Silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| 2nd Layer: Interlayer: | |
| Fine Silver Halide Particles (average grain diameter: 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| 3rd Layer: 1st Red-Sensitive Emulsion Layer: | |
| Silver Iodobromide Emulsion (AgI: 2 mol %, high internal AgI type, sphere equivalent diameter: 0.3 μm, sphere equivalent diameter variation coefficient: 29%, mixed regular crystal, twin crystal grains, diameter/thickness ratio: 2.5) | |
| Coated silver quantity | 0.4 |
| Gelatin | 0.6 |
| ExS-1 | $1 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |
| Solv-1 | 0.03 |
| Solv-3 | 0.012 |
| 4th Layer: 2nd Red-Sensitive Emulsion Layer: | |
| Silver Iodobromide Emulsion (AgI: 5 mol %, high internal AgI type, sphere equivalent diameter: 0.7 μm, sphere equivalent diameter variation coefficient: 25%, mixed regular crystal, twin crystal grains, diameter/thickness ratio: 4) | |
| Coated silver quantity | 0.7 |
| Gelatin | 0.5 |
| ExS-1 | $1 \times 10^{-4}$ |
| ExS-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| 5th Layer: 3rd Red-Sensitive Emulsion Layer: | |
| Silver Iodobromide Emulsion (AgI: 10 mol %, high internal AgI type, sphere equivalent diameter: 0.8 μm, sphere equivalent diameter variation coefficient: 16%, mixed regular crystal, twin crystal grains, diameter/thickness ratio: 1.3) | |
| Coated silver quantity | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |
| 6th Layer: Interlayer: | |
| Gelatin | 1.0 |
| Cpd-1 | 0.03 |
| Solv-1 | 0.05 |
| 7th Layer: 1st Green-Sensitive Emulsion Layer: | |
| Silver Iodobromide Emulsion (AgI: 2 mol %, high internal AgI type, | |

-continued

| | |
|---|---|
| sphere equivalent diameter: 0.3 μm, sphere equivalent diameter variation coefficient: 28%, mixed regular crystal, twin crystal grains, diameter/thickness ratio: 2.5) | |
| Coated silver quantity | 0.30 |
| ExS-4 | $5 \times 10^{-4}$ |
| ExS-6 | $0.3 \times 10^{-4}$ |
| ExS-5 | $2 \times 10^{-4}$ |
| Gelatin | 1.0 |
| ExM-9 | 0.2 |
| ExY-14 | 0.03 |
| ExM-8 | 0.03 |
| Solv-1 | 0.5 |
| 8th Layer: 2nd Green-Sensitive Emulsion Layer: | |
| Silver Iodobromide Emulsion (AgI: 4 mol %, high internal AgI type, sphere equivalent diameter: 0.6 μm, sphere equivalent diameter variation coefficient: 38%, mixed regular crystal, twin crystal grains, diameter/thickness ratio: 4) | |
| Coated silver quantity | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |
| 9th Layer: 3rd Green-Sensitive Emulsion Layer: | |
| Silver Iodobromide Emulsion (AgI: 6 mol %, high internal AgI type, sphere equivalent diameter: 1.0 μm, sphere equivalent diameter variation coefficient: 80%, mixed regular crystal, twin crystal grains, diameter/thickness ratio: 1.2) | |
| Coated silver quantity | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| 10th Layer: Yellow Filter Layer: | |
| Gelatin | 1.2 |

-continued

| | |
|---|---|
| Yellow Colloidal Silver | 0.08 |
| Cpd-2 | 0.1 |
| Solv-1 | 0.3 |
| 11th Layer: 1st Blue-Sensitive Emulsion Layer: | |
| Silver Iodobromide Emulsion (AgI: 4 mol %, high internal AgI type, sphere equivalent diameter: 0.5 μm, sphere equivalent diameter variation coefficient: 15%, octahedral grains) | |
| Coated silver quantity | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| 12th Layer: 2nd Blue-Sensitive Emulsion Layer: | |
| Silver Iodobromide Emulsion AgI: 10 mol %, high internal AgI type, sphere equivalent diameter: 1.3 μm; sphere equivalent diameter variation coefficient: 25%, mixed regular crystal, twin crystal grains, diameter/thickness ratio: 4.5) | |
| Coated silver quantity | 0.5 |
| Gelatin | 0.6 |
| ExS-9 | $1 \times 10^{-4}$ |
| ExY-16 | 0.25 |
| Solv-1 | 0.07 |
| 13th Layer: 1st Protective Layer: | |
| Gelatin | 0.8 |
| UV-1 | 0.1 |
| UV-2 | 0.2 |
| Solv-1 | 0.01 |
| Solv-2 | 0.02 |
| 14th Layer: 2nd Protective Layer: | |
| Fine Silver Bromide Particles (average grain diameter: 0.07 μm) | 0.5 |
| Gelatin | 0.45 |
| Polymethyl Methacrylate Grains (diameter: 1.5 μm) | 0.2 |
| H-1 | 0.4 |
| Cpd-3 | 0.5 |
| Cpd-4 | 0.5 |

Each of the above layers additionally contains a surface active agent (surfactant) as a coating aid. The sample material prepared in the manner noted above was designated as Sample 101.

Below, the chemical structural formulae and chemical names of compounds used in the present invention are indicated.

UV-1:

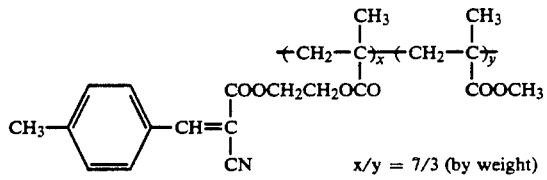

x/y = 7/3 (by weight)

UV-2:

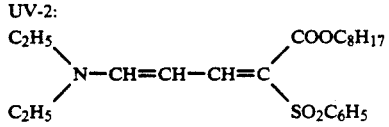

Solv-1 Tricresyl Phosphate
Solv-2 Dibutyl Phthalate
Solv-3 Bis(2-ethylhexyl) Phthalate ExM-8:

-continued
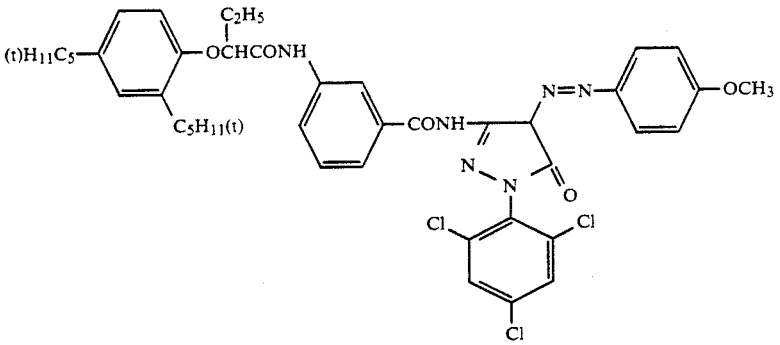
ExF-1:
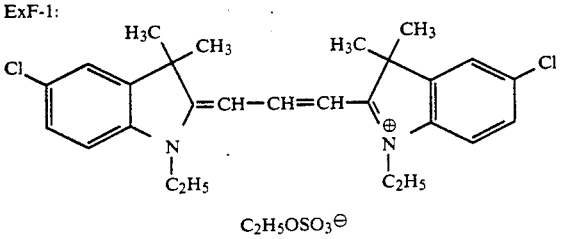
ExC-2:
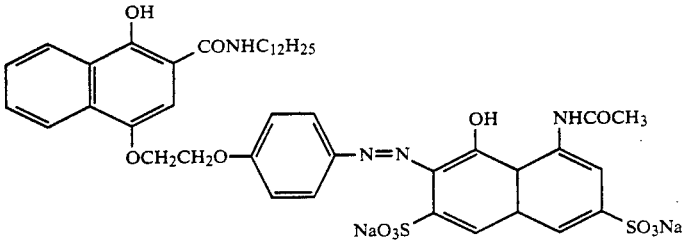
ExC-3:
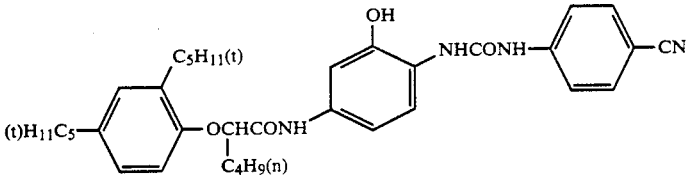
ExC-4:
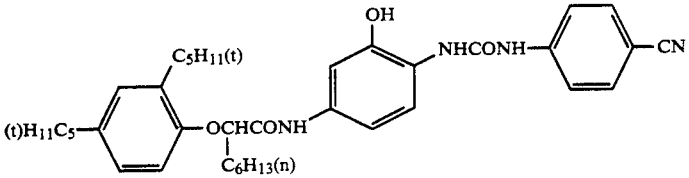
ExY-14:
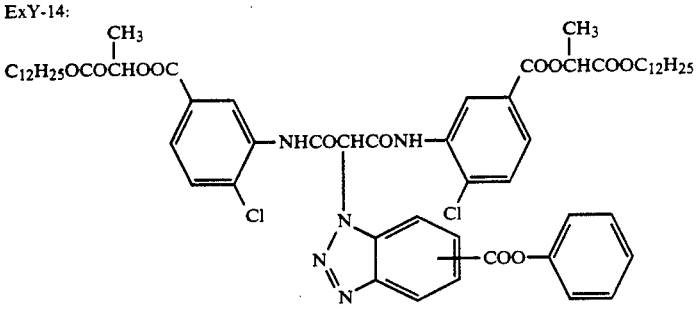
ExY-15:

-continued
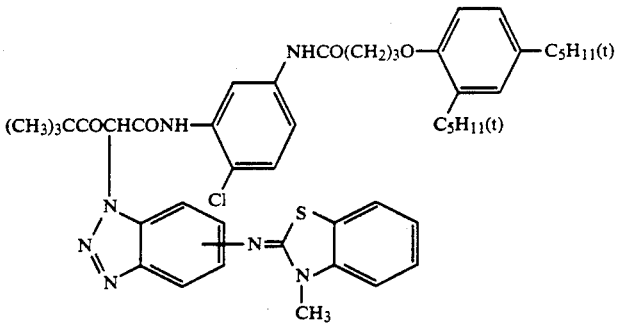
ExC-5:
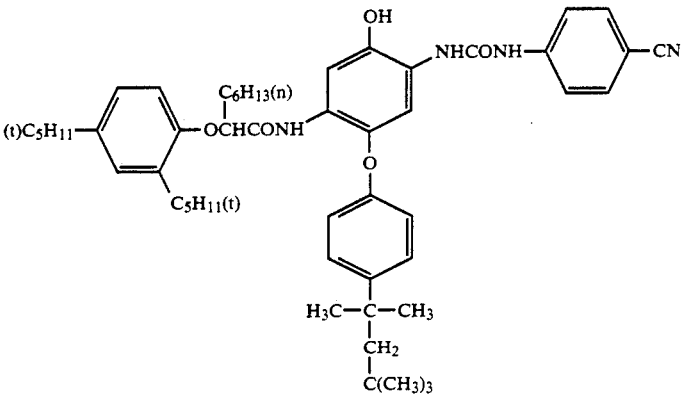
ExC-6:
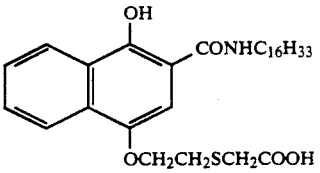
ExC-7:
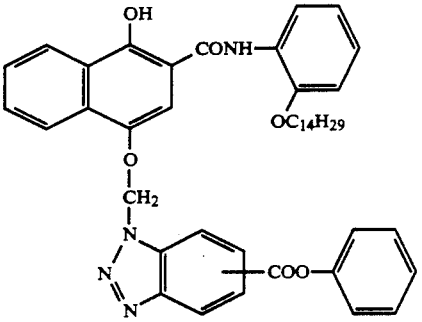
ExM-9:

-continued
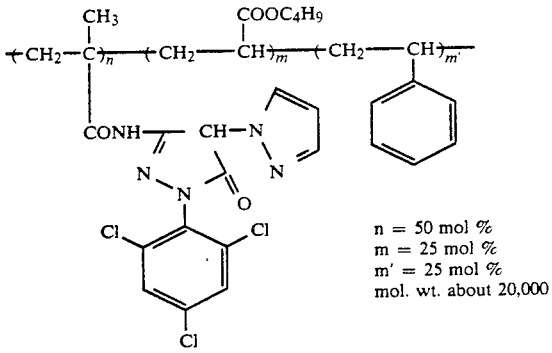
n = 50 mol %
m = 25 mol %
m' = 25 mol %
mol. wt. about 20,000
ExM-10:
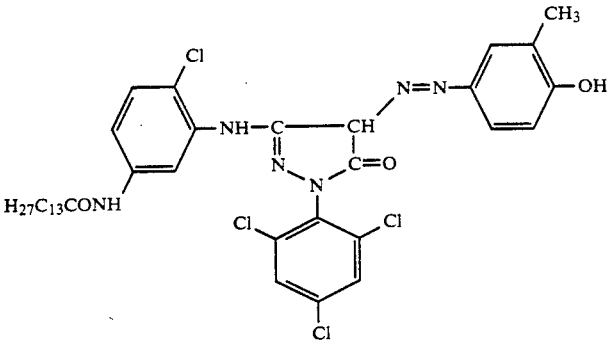
ExM-11:
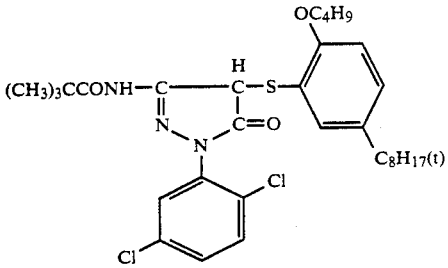
ExM-12:
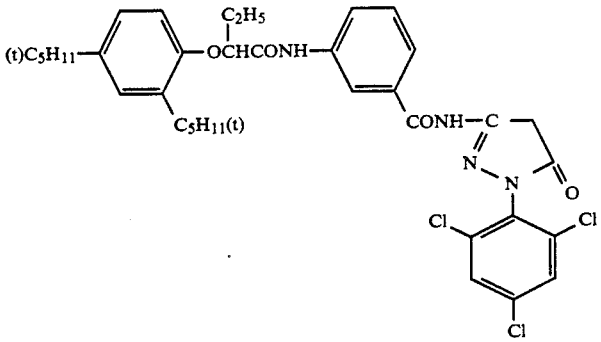
ExM-13:

-continued
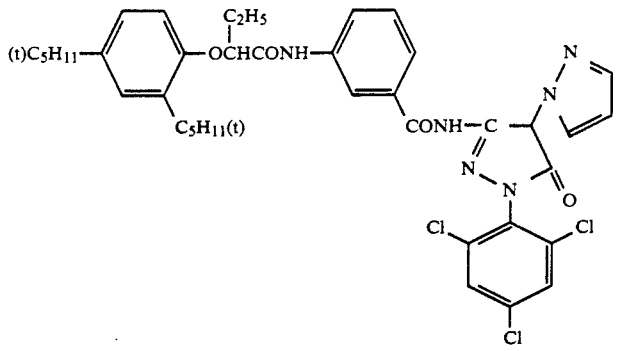
ExY-16:
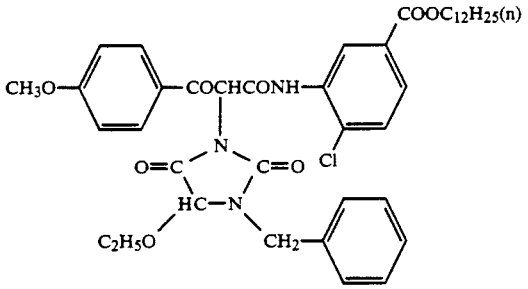
Cpd-1:
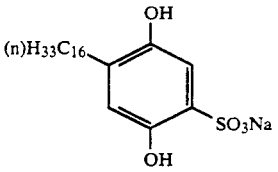
Cpd-2:
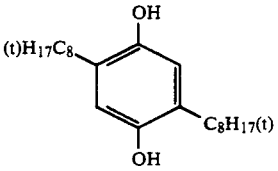
ExS-1:
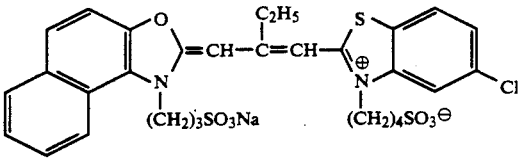
ExS-2:
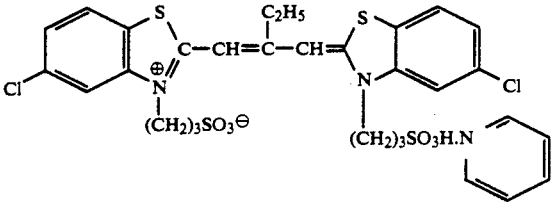
ExS-3:

-continued
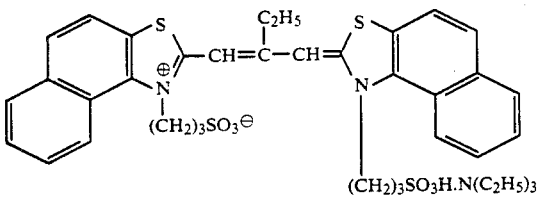
ExS-4:
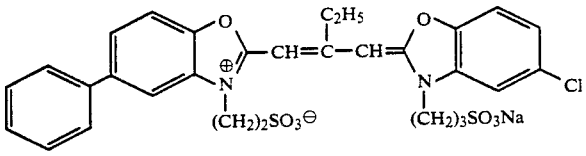
ExS-5:
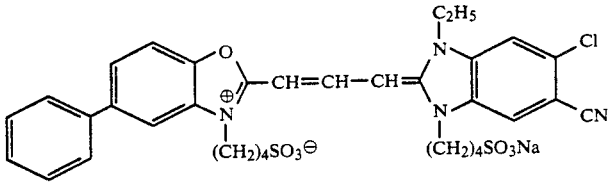
ExS-6:
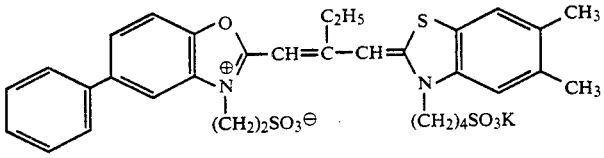
ExS-7:
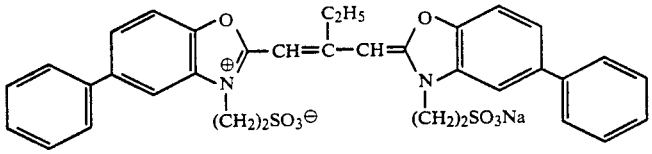
ExS-8:
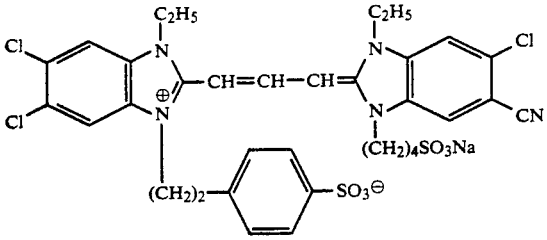
ExS-9:
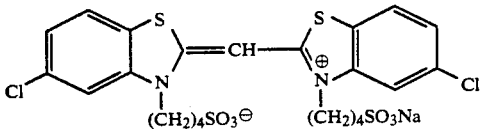
H-1:
$CH_2{=}CH{-}SO_2{-}CH_2{-}CONH{-}CH_2$
$CH_2{=}CH{-}SO_2{-}CH_2{-}CONH{-}CH_2$
Cpd-3:

-continued

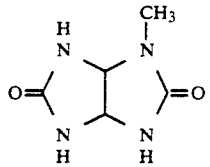

Cpd-4:

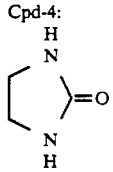

Also, processing solutions having the following compositions were prepared.

| | Mother Liquor | Replenisher |
|---|---|---|
| Color Development Solution (color developing solution): | | |
| Diethylenetriaminepentaacetic Acid | 5.0 g | 6.0 g |
| Sodium Sulfite | 4.0 g | 5.0 g |
| Potassium Carbonate | 30.0 g | 37.0 g |
| Potassium Bromide | 1.3 g | 0.5 g |
| Potassium Iodide | 1.2 mg | — |
| Hydroxylamine Sulfate | 2.0 g | 3.6 g |
| 4-(N-Ethyl-N-β-hydroxyethyl-amino)-2-methylaniline Sulfate | 4.7 g | 6.2 g |
| Water to make | 1.0 liter | 1.0 liter |
| pH | 10.00 | 10.15 |
| Bleaching Solutions (A)-(F): | | |
| Bleaching Agent Noted in Table 1-1 | See Table 1-1 | See Table 1-1 |
| 1,3-Diaminopropanetetraacetic Acid | 3.0 g | 4.0 g |
| Ammonium Bromide | 85 g | 120 g |
| Acetic Acid | 50 g | 70 g |
| Ammonium Nitrate | 30 g | 40 g |
| Water to make | 1.0 liter | 1.0 liter |
| pH Adjustment | 4.3 | 3.5 |
| Fixing Solution: | | |
| Compound Noted in Table 1-2 | See Table 1-2 | See Table 1-2 |
| Sodium Sulfite | 10.0 g | 12.0 g |
| Sodium Bisulfite | 8.0 g | 10.0 g |
| Ammonium Thiosulfate Aqueous Solution (700 g/liter) | 170.0 ml | 200.0 ml |
| Ammonium Rhodanate | 100.0 g | 150.0 g |
| Thiourea | 3.0 g | 5.0 g |

-continued

| | | |
|---|---|---|
| 3,6-Dithia-1,8-octanediol | 3.0 g | 5.0 g |
| Water to make | 1.0 liter | 1.0 liter |
| pH (adjusted by addition of ammonium acetate) | 6.5 | 6.7 |

| Stabilization Solution (stabilizing solution): Same for both mother liquor and replenisher | |
|---|---|
| Formalin (37 wt %) | 1.2 ml |
| 5-Chloro-2-methyl-4-isothiazolin-3-one | 6.0 mg |
| 2-Methyl-4-isothiazolin-3-one | 3.0 mg |
| Surfactant: $C_{10}H_{21}$—$O(CH_2CH_2O)_{10}H$ | 0.4 g |
| Ethylene Glycol | 1.0 g |
| Water to make | 1.0 liter |
| pH | 5.0 to 7.0 |

Processing was carried out in an automatic developing machine using color photosensitive material and processing solutions were prepared as indicated above. The process steps were shown in Table 2 below.

TABLE 2

Processing Steps

| Processing Step | Processing Temperature (°C.) | Time | Replenishment Quantity* | Tank Capacity (l) |
|---|---|---|---|---|
| Color Development | 37.8 | 3 min 15 sec | 21 | 5 |
| Bleaching | 38.0 | 45 sec | 4.5 | 2 |
| Fixing (1) | 38.0 | 45 sec | (two-tank counter-current system) 30 | 2 |
| Fixing (2) | 38.0 | 45 sec | | 2 |
| Stabilization (1) | 38.0 | 20 sec | (three-tank counter-current system) 35 | 1 |
| Stabilization (2) | 38.0 | 20 sec | | 1 |
| Stabilization (3) | 38.0 | 20 sec | | 1 |
| Drying | 55 | 1 min 00 sec | | |

*Replenishment quantity: per 1 m length of a photosensitive material with 35 mm wide A jet stirring device as described on page 3 of JP-A-62-183460 was provided in the fixing tank of the automatic developing machine that was used and processing was effected with the fixing solution striking against the emulsion surface of photosensitive material.

TABLE 1-1

Bleaching Agent Used in the Bleaching Solution

| | Bleaching Agent | Molar Quantity per 1 Liter of Bleaching Solution (mol) | pH |
|---|---|---|---|
| Bleaching Solution A | (Ethylenediamine-tetraacetato) Iron (III) Ammonium Salt | 0.25 | 6.0 |
| Bleaching Solution B | (1,3-Diaminopropane-tetraacetato) Iron (III) Ammonium | 0.1 | 6.0 |

TABLE 1-1-continued

| Bleaching Agent Used in the Bleaching Solution | | | |
|---|---|---|---|
| | Bleaching Agent | Molar Quantity per 1 Liter of Bleaching Solution (mol) | pH |
| Bleaching Solution C | Salt (1,3-Diaminopropane-tetraacetato) Iron (III) Ammonium Salt | 0.25 | 6.0 |
| Bleaching Solution D | Salt (1,3-Diaminopropane-tetraacetato) Iron (III) Ammonium Salt | 0.25 | 4.5 |
| Bleaching Solution E | Salt (1,3-Diaminopropane-tetraacetato) Iron (III) Ammonium Salt | 0.25 | 3.5 |
| Bleaching Solution F | Salt (1,3-Diaminopropane-tetraacetato) Iron (III) Ammonium Salt | 0.25 | 2.0 |

diaminopropanetetraacetato)Fe (III) salt and with which the pH was in the range 2.5 to 5.5 as in the bleach according to the present invention.

Within these, however, improper desilvering occurred and fixing solution became very turbid after one week's running processing in the conditions of Nos. I-6 and I-8 in which a compound according to the present invention was not included in the fixing solution.

It will thus be appreciated from this example that, under rapid processing conditions, satisfactory desilvering is possible only with a bleaching solution that has a pH of 2.5 to 5.5 and contains 0.2 mol/liter or more of a (1,3-diaminopropanetetraacetato)iron (III) salt as disclosed in the present invention, and that the problem occurring when use is made of this bleaching solution composition permitting rapid processing (deterioration of the fixing solution due to carry-over of bleaching components into the fixing bath) is resolved by including a compound of the present invention in the fixing solution.

EXAMPLE 2

TABLE 1-2

| | | | | At the Start of Processing | | | After Processing for 1 Week Running | | |
|---|---|---|---|---|---|---|---|---|---|
| Condition No. | Remarks | Bleaching Solution | Additives to Fixing Solution | Amount of Residual Silver ($\mu g/cm^2$) | Bleaching Fog ($\Delta D$) | Fixing Solution Turbidity | Amount of Residual Silver ($\mu g/cm^2$) | Bleaching Fog ($\Delta D$) | Fixing Solution Turbidity |
| I-1 | Comparison | Bleaching Solution (A) | None | 9 | 0.01 | None | 12 | 0.01 | None |
| I-2 | " | Bleaching Solution (A) | 1.5 g/l of compound A-(1) in this text | 9.5 | 0.01 | None | 11 | 0.01 | None |
| I-3 | " | Bleaching Solution (A) | None | 4.1 | 0.04 | None | 6 | 0.03 | Slight turbidity |
| I-4 | " | Bleaching Solution (C) | None | 3.2 | 0.08 | None | 5 | 0.05 | Slight turbidity |
| I-5 | " | Bleaching Solution (C) | 1.5 g/l of compound A-(1) in this text | 3.1 | 0.08 | None | 5.2 | 0.07 | None |
| I-6 | " | Bleaching Solution (D) | None | 2.1 | 0.02 | None | 8.1 | 0.01 | Considerable turbidity |
| I-7 | Invention | Bleaching Solution (D) | 1.5 g/l of compound A-(1) in this text | 2.2 | 0.01 | None | 2.5 | 0.01 | None |
| I-8 | Comparison | Bleaching Solution (E) | None | 2.2 | 0.02 | None | 12.1 | 0.01 | Considerable turbidity |
| I-9 | Invention | Bleaching Solution (E) | 1.5 g/l of compound A-(1) in this text | 2.1 | 0.01 | None | 2.2 | 0.01 | None |
| I-10 | Comparison | Bleaching Solution (F) | None | 2.0 | 0.04 | None | 10.1 | 0.02 | Extreme turbidity |
| I-11 | Comparison | Bleaching Solution (F) | 1.5 g/l of compound A-(1) in this text | 1.9 | 0.042 | None | 2.1 | 0.03 | Slight turbidity |
| I-12 | Invention | Bleaching Solution (E) | 10 g/l of compound A-(3) in this text | 2.1 | 0.01 | " | 2.5 | 0.01 | None |
| I-13 | " | Bleaching Solution (E) | 5 g/l of compound A-(4) of this text | 2.0 | 0.03 | " | 2.3 | 0.03 | " |
| I-14 | " | Bleaching Solution (E) | 6 g/l of compound A-(5) of this text | 2.3 | 0.01 | " | 2.4 | 0.01 | " |
| I-15 | " | Bleaching Solution (E) | 3 g/l of compound B-(1) of this text | 2.1 | 0.01 | " | 2.2 | 0.02 | " |
| I-16 | " | Bleaching Solution (E) | 3.5 g/l of compound B-(25) of this text | 2.0 | 0.,02 | " | 2.3 | 0.02 | " |
| I-17 | " | Bleaching Solution (E) | 3.5 g/l of compound B-(41) of this text | 1.9 | 0.01 | " | 2.0 | 0.02 | " |

Processing was effected at the rate of 10 m per day of sensitive material with 35 mm wide. Fluorescent X-ray analysis was used to measure the amount of residual silver after processing, bleaching fog in unexposed portions was measured and observations were made on the turbidity of the fixing solution at that time.

Findings are shown in Table 1-2. It is seen that there was an absence of bleaching fog and satisfactory desilvering was effected only in the conditions of Nos. I-6 to I-9 which contained 0.2 mol/liter or more of the (1,3-

Sample 201 in the form of a multilayer color photosensitive material constituted by layers with the compositions noted below was prepared on an undercoated triacetyl cellulose film support.

Composition of Photosensitive Layers

Regarding the amount of the respective components as coated, the silver halide and colloidal silver are represented by the units of g/m$^2$ as silver coated; the coupler, additives and gelatin are represented by the units of g/m$^2$; and the sensitizing dye is represented by the number of mols per mol of the silver halide in the same layer. In cases where an additive has a plurality of effects, only one effect is noted as being typical of the material.

Abbreviations used in the compositions shown have the following meanings:

UV: Ultraviolet absorbent
Solv: High boiling organic solvent
ExF: Dye
ExS: Sensitizing dye
ExC: Cyan coupler
ExM: Magenta coupler
ExY: Yellow coupler
Cpd: Additive
H: Hardening agent

| | |
|---|---|
| 1st Layer: Antihalation Layer: | |
| Black Colloidal Silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |
| 2nd Layer: Slow Speed Red-Sensitive Emulsion Layer: | |
| Silver Iodobromide Emulsion (AgI: 4 mol %, uniform AgI type, sphere equivalent diameter: 0.4 μm, sphere equivalent diameter variation coefficient: 37%, tabular grains, diameter/thickness ratio: 3.0) | |
| Coated silver quantity | 0.4 |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.18 |
| 3rd Layer: Medium Speed Red-Sensitive Emulsion Layer: | |
| Silver Iodobromide Emulsion (AgI: 6 mol %, 2/1 core shell ratio high internal AgI type, sphere equivalent diameter: 0.65 μm, sphere equivalent diameter variation coefficient: 25%, tabular grains, diameter/thickness ratio: 2.0) | |
| Coated silver quantity | 0.65 |
| Silver Iodobromide Emulsion (AgI: 4 mol %, uniform AgI type, sphere equivalent diameter: 0.4 μm, sphere equivalent diameter variation coefficient: 37%, tabular grains, diameter/thickness ratio: 3.0) | |
| Coated silver quantity | 0.1 |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-4}$ |
| ExC-1 | 0.31 |
| ExC-2 | 0.01 |
| ExC-3 | 0.06 |
| 4th Layer: High Speed Red-Sensitive Emulsion Layer: | |
| Silver Iodobromide Emulsion (AgI: 6 mol %, 2/1 core shell ratio high internal AgI type, sphere equivalent diameter: 0.7 μm, sphere equivalent diameter variation coefficient: 25%, tabular grains, diameter/thickness ratio: 2.5) | |
| Coated silver quantity | 0.9 |
| Gelatin | 0.8 |

-continued

| | |
|---|---|
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |
| 5th Layer: Interlayer: | |
| Gelatin | 0.6 |
| Solv-4 | 0.03 |
| Solv-5 | 0.04 |
| Cpd-1 | 0.1 |
| Polyethylacrylate Latex | 0.08 |
| Solv-1 | 0.05 |
| 6th Layer: Slow Speed Green-Sensitive Emulsion Layer: | |
| Silver Iodobromide Emulsion (AgI: 4 mol %, uniform AgI type, sphere equivalent diameter: 0.4 μm, sphere equivalent diameter variation coefficient: 37%, tabular grains, diameter/thickness ratio: 2.0) | |
| Coated silver quantity | 0.18 |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| 7th Layer: Medium Speed Green-Sensitive Emulsion Layer: | |
| Silver Iodobromide Emulsion (AgI: 4 mol %, 2/1 core shell ratio high internal AgI type, sphere equivalent diameter: 0.5 μm, sphere equivalent diameter variation coefficient: 20%, tabular grains, diameter/thickness ratio: 4.0) | |
| Coated silver quantity | 0.27 |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| 8th Layer: High Speed Green-Sensitive Emulsion Layer: | |
| Silver Iodobromide Emulsion (AgI: 8.7 mol %, silver quantity ratio 3/4/2 multilayer structure grains, Ag content going from the interior: 24 mol %, 0 mol %, 3 mol %, sphere equivalent diameter: 0.7 μm, sphere equivalent diameter variation coefficient: 25%, tabular grains, diameter/thickness ratio: 1.6) | |
| Coated silver quantity | 0.7 |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| 9th Layer: Interlayer: | |
| Gelatin | 0.6 |
| Cpd-1 | 0.04 |
| Polyethylacrylate Latex | 0.12 |
| Solv-1 | 0.02 |

10th Layer: Donatinq Layer with Interlayer Effect for

-continued

| | |
|---|---|
| Red-Sensitive Emulsion Layer: | |
| Silver Iodobromide Emulsion Layer (AgI: 6 mol %, core shell ratio 2/1 high internal AgI type, sphere equivalent diameter: 0.7 μm, sphere equivalent diameter variation coefficient: 25%, tabular grains, diameter/thickness ratio: 2.0) | |
| Coated silver quantity | 0.68 |
| Silver Iodobromide Emulsion (AgI: 4 mol %, uniform AgI type, sphere equivalent diameter: 0.4 μm, sphere equivalent diameter variation coefficient: 37%, tabular grains, diameter/thickness ratio: 3.0) | |
| Coated silver quantity | 0.19 |
| Gelatin | 1.0 |
| ExS-4 | $6 \times 10^{-4}$ |
| ExM-10 | 0.19 |
| Solv-1 | 0.20 |
| 11th Layer: Yellow Filter Layer: | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| 12th Layer: Slow Speed Blue-sensitive Emulsion Layer: | |
| Silver Iodobromide Emulsion (AgI: 4.5 mol %, uniform AgI type, sphere equivalent diameter: 0.7 μm; sphere equivalent diameter variation coefficient: 15%, tabular grains, diameter/thickness ratio: 7.0) | |
| Coated silver quantity | 0.3 |
| Silver Iodobromide Emulsion (AgI: 3 mol %, uniform AgI type, sphere equivalent diameter: 0.3 μm, sphere equivalent diameter variation coefficient: 30%, tabular grains, diameter/thickness ratio: 7.0) | |
| Coated silver quantity | 0.15 |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| 13th Layer: Interlayer: | |
| Gelatin | 0.7 |
| ExY-12 | 0.20 |
| Solv-1 | 0.34 |
| 14th Layer: High Speed Blue-Sensitive Emulsion Layer: | |
| Silver Iodobromide Emulsion (AgI: 10 mol %, high internal AgI type, sphere equivalent diameter: 1.0 μm, sphere equivalent diameter variation coefficient: 25%, multilayer twin crystal tabular grains, diameter/thickness ratio: 2.0) | |
| Coated silver quantity | 0.5 |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| 15th Layer: 1st Protective Layer: | |
| Fine Silver Iodobromide Emulsion (AgI: 2 mol %, uniform AgI type, sphere equivalent diameter: 0.07 μm) | |
| Coated silver quantity | 0.12 |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethylacrylate Latex | 0.09 |
| 16th Layer: 2nd Protective Layer: | |
| Fine Silver Iodobromide Emulsion (AgI: 2 mol %, uniform AgI type, sphere equivalent diameter: 0.07 μm) | |
| Coated silver quantity | 0.36 |
| Gelatin | 0.55 |
| Polyethylacrylate Grains (diameter: 1.5 μm) | 0.2 |
| H-1 | 0.17 |

As well as the above components, Emulsion Stabilizer Cpd-3 (0.07 g/m$^2$) and Surfactant Cpd-4 (0.03 g/m$^2$) as a coating aid were added.

UV-1

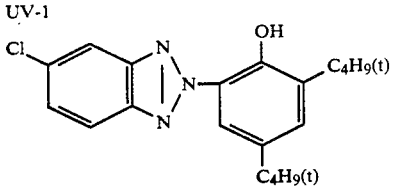

UV-2

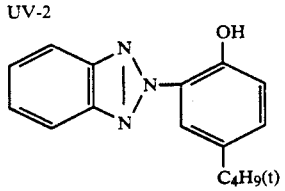

UV-3

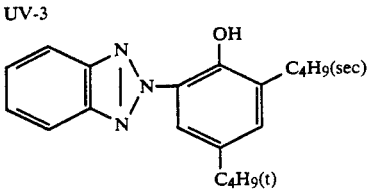

UV-4

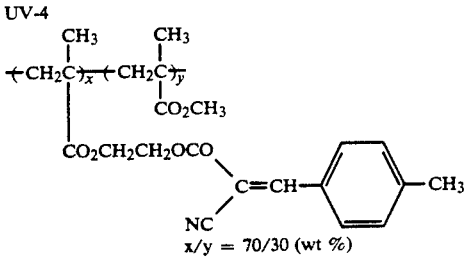

x/y = 70/30 (wt %)

UV-5

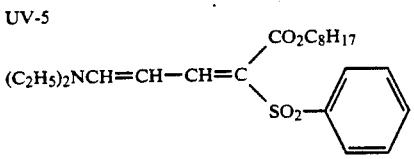

Solv-1:
Tricresyl Phosphate

Solv-2:

Solv-4

Dibutyl Phthalate
-continued
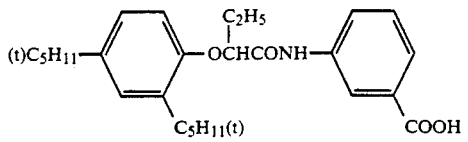
Solv-5
Trihexyl Phosphate
ExF-1
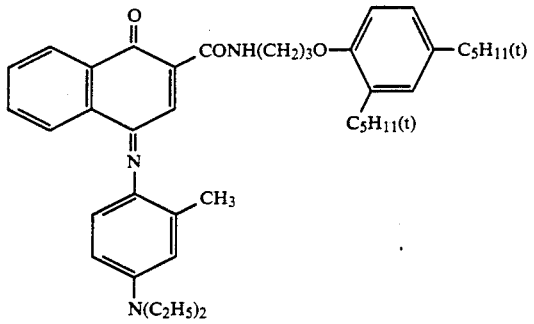
ExF-2
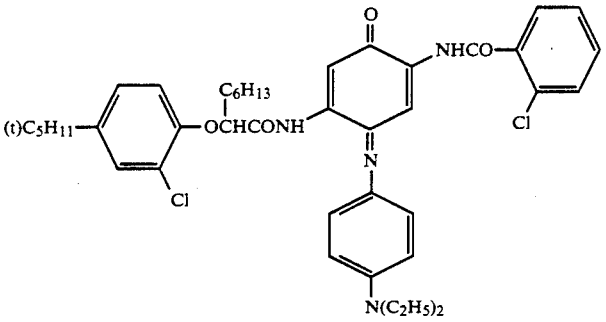
ExS-1
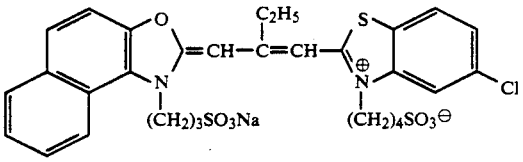
ExS-2
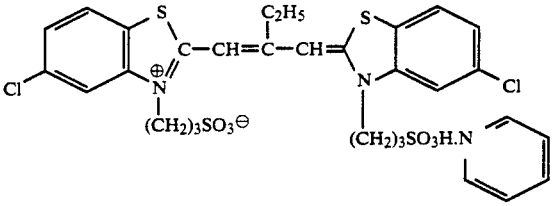
ExS-3
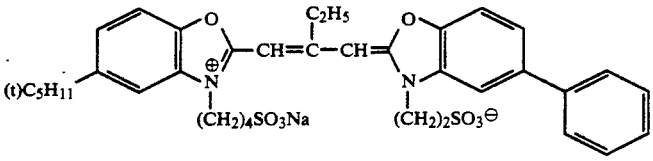
ExS-4
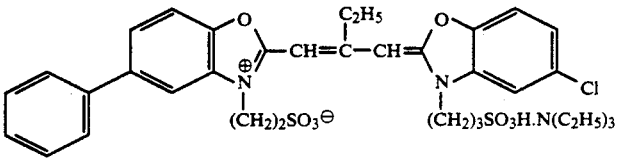
ExS-5

-continued
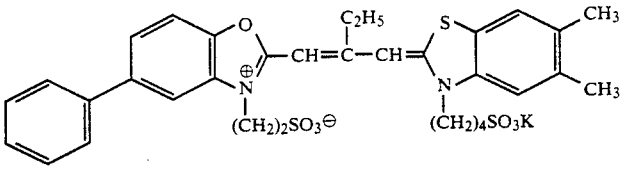
ExS-6
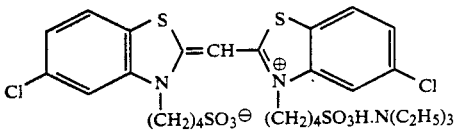
Ex-7
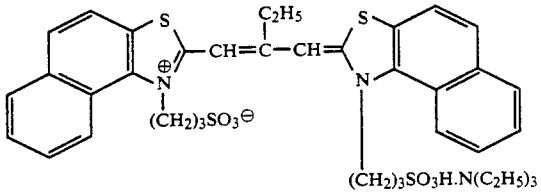
ExS-8
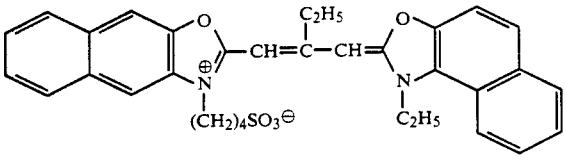
ExC-1
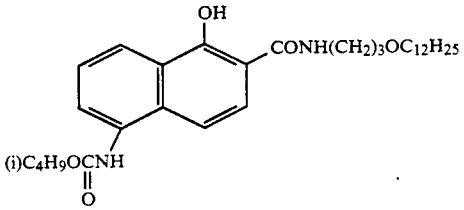
ExC-2
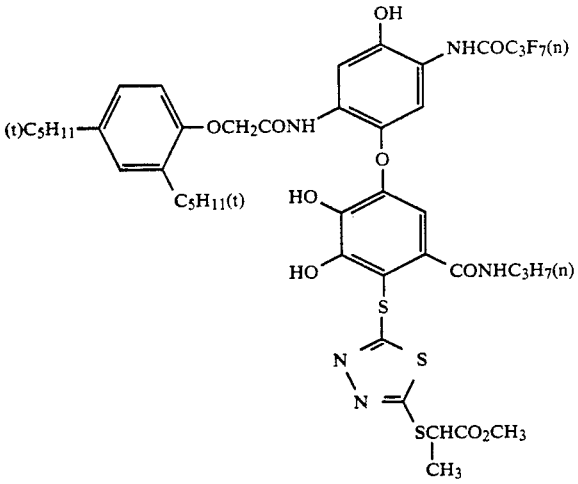
ExC-3
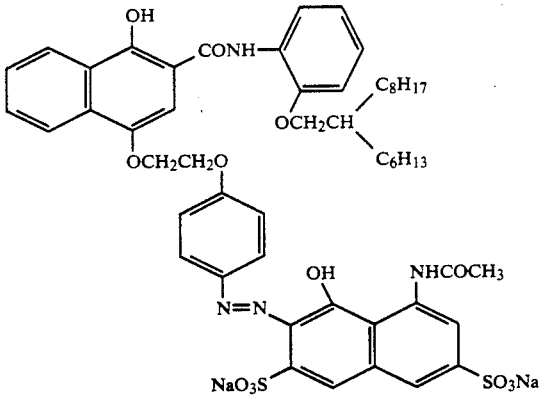
ExC-4
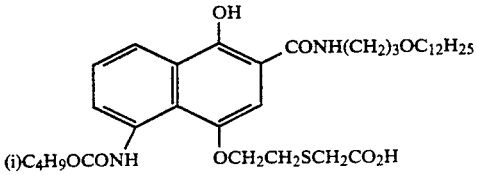
ExM-5

-continued
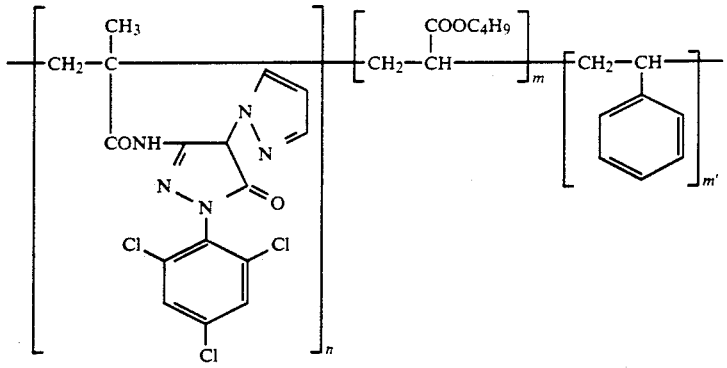
n = 50 mol %
m = 25 mol %
m' = 25 mol %
mol. wt. about 20,000
ExM-6
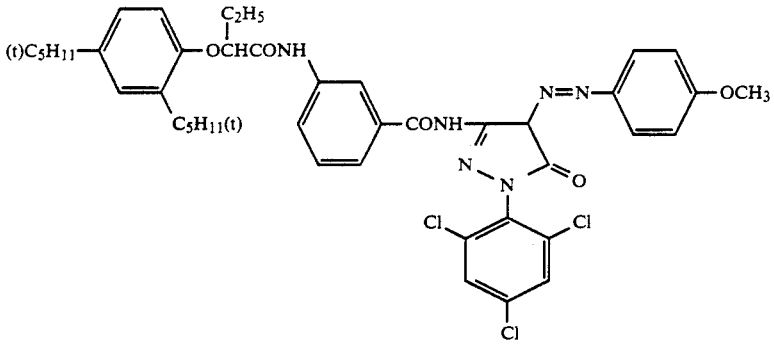
ExM-7
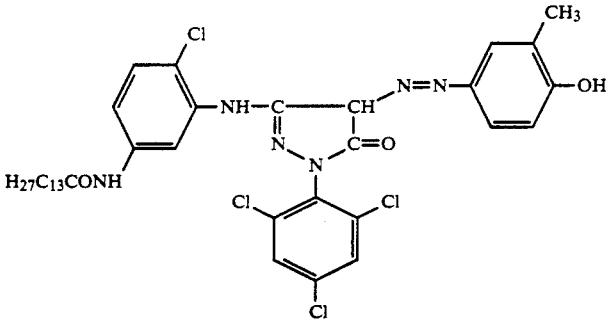
ExM-10
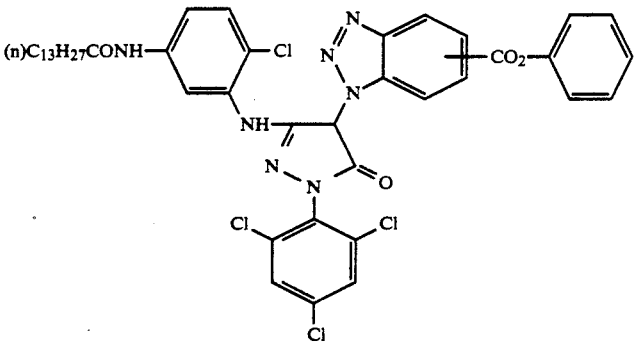
ExY-8

-continued
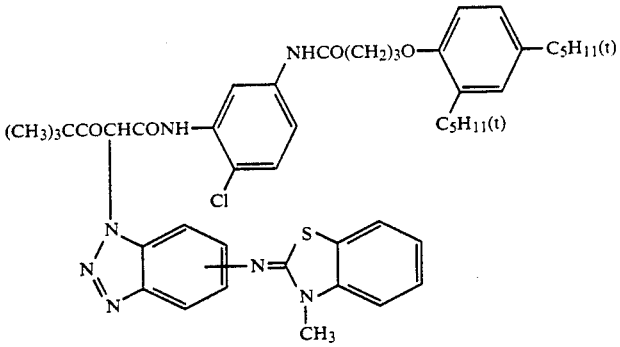
ExY-9
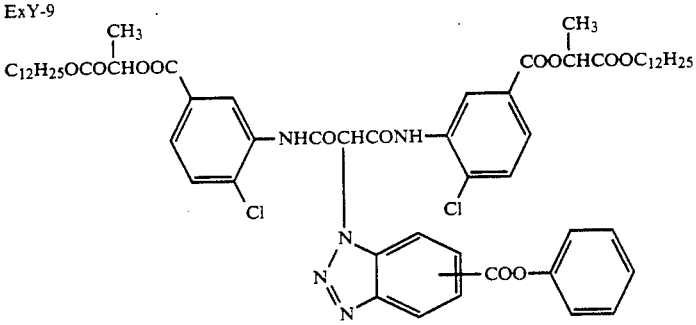
ExY-11
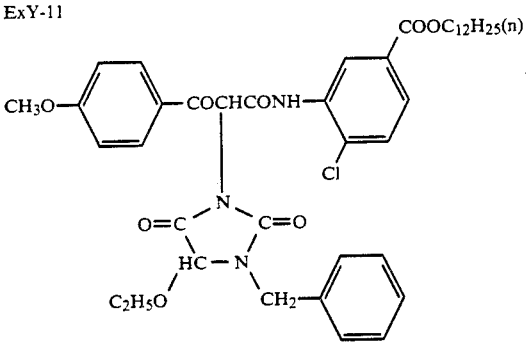
ExY-12
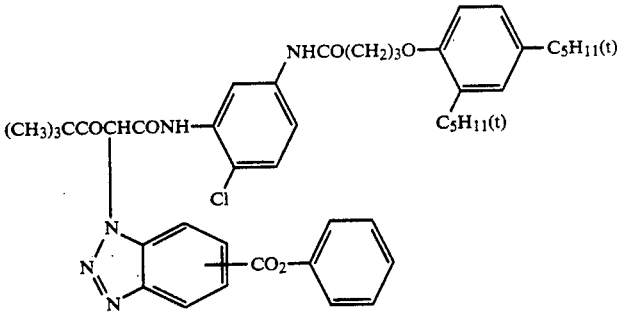
Cpd-7
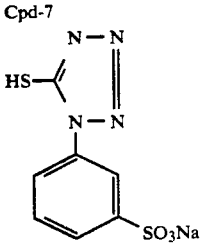
Cpd-1
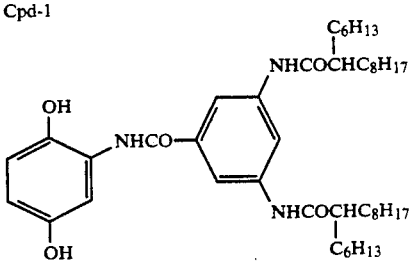

-continued

Cpd-2

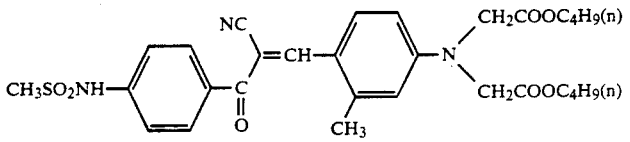

Cpd-6

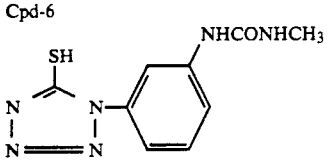

Cpd-5

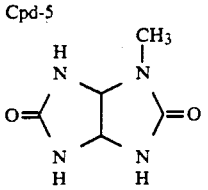

Cpd-3

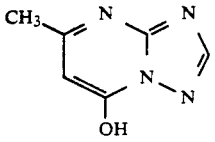

Cpd-4

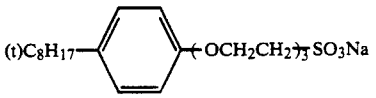

H-1

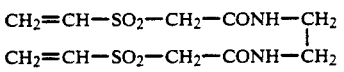

The following processing solutions too were prepared.

| | Mother Liquor | Replenisher |
|---|---|---|
| Color Developing Solution: | | |
| Diethylenetriaminepentaacetic Acid | 5.0 g | 7.0 g |
| Sodium Sulfite | 4.0 g | 6.0 g |
| Potassium Carbonate | 30.0 g | 35.0 g |
| Potassium Bromide | 1.3 g | 0.2 g |
| Potassium Iodide | 1.2 mg | — |
| Hydroxylamine Sulfate | 2.0 g | 4.0 g |
| 4-(N-Ethyl-N-β-hydroxytethyl-amino)-2-methylaniline Sulfate | 4.7 g | 6.5 g |
| 1-Hydroxyethylidene-1,1-phosphonate | 3.0 g | 4.0 g |
| Water to make | 1.0 liter | 1.0 liter |
| pH | 10.05 | 10.20 |
| Bleaching Solution: | | |
| (1,3-Diaminopropanetetra-acetato)Iron (III) Complex Salt | 120 g | 180 g |
| 1,3-Diaminopropanetetra-acetic Acid | 3.0 g | 5.0 g |
| Ammonium Bromide | 100 g | 150 g |
| Acetic Acid | 50 g | 80 g |
| Ammonium Nitrate | 30 g | 40 g |
| Water to make | 1.0 liter | 1.0 liter |
| pH (adjusted by addition of acetic acid and ammonia) | 4.0 | 3.3 |
| Fixing Solution: | | |
| Compound Shown in Table 3 | 0.08 mol | 0.11 mol |
| Ammonium Sulfite | 16.0 g | 25.0 g |
| Ammonium Thiosulfate Aqueous Solution (700 g/liter) | 240.0 ml | 280.0 ml |
| 3,6-Dithia-1,8-octanediol | 5.0 g | 7.0 g |
| Water to make | 1.0 liter | 1.0 liter |
| pH (adjusted by addition of acetic acid and ammonium) | 6.5 | 6.5 |
| Washing Water: | Same for both mother liquor and replenisher | |

Tap water was passed through a mixed bed type column filled with an H-type strongly acidic cation exchange resin ("Amberlite IR-120B" manufactured by Rohm & Haas Company) and an OH-type anion exchange resin ("Amberlite IR-400" manufactured by Rohm & Haas Company) and the calcium and magnesium ion concentration was decreased to 3 mg/liter or less, respectively, and then 20 mg/liter of sodium dichloride isocyanurate and 0.15 g/liter of sodium sulfate were added.

The pH of this solution was in the range of 6.5 to 7.5.

Stabilization Solution (stabilizing solution):

| | Mother Liquor | Replenisher |
|---|---|---|
| Formalin (37 wt %) | 2.0 ml | 3.0 ml |
| Polyethylene p-Monononylphenyl Ether (average polymerization degree: 10) | 0.3 g | 0.45 g |
| Ethylenediaminetetraacetic Acid Disodium Salt | 0.05 g | 0.08 g |
| Water to make | 1.0 liter | 1.0 liter |
| pH | 5.0 to 8.0 | 5.0 to 8.0 |

Processing was carried out in the following steps and with the following processing solutions in an automatic developing machine.

TABLE 3

| Processing Step | Processing Temperature (°C.) | Time | Replenishment Quantity* | Tank Capacity (l) |
|---|---|---|---|---|
| | | Processing Steps | | |
| Color Development | 40.0 | 2 min 15 sec | 15 | 4 |
| Bleaching | 38.0 | 45 sec | 4.5 | 2 |
| Fixing (1) | 38.0 | 45 sec | (two-tank counter-current system) 15 | 2 |
| Fixing (2) | 38.0 | 45 sec | | 2 |
| Washing (1) | 38.0 | 15 sec | (two-tank counter-current system) 15 | 1 |
| Washing (2) | 38.0 | 15 sec | | 1 |
| Stabilization | 38.0 | 15 sec | 15 | 1 |
| Drying | 60.0 | 45 sec | | |

*Replenishment quantity is per 1 m length of a photosensitive material with 35 mm wide.

The automatic developing machine employed had a fixing solution jet stirring device as in Example 1.

As described in Example 1, processing was effected at a rate of 10 m per day of photosensitive material with 35 mm wide. Using fluorescent X-ray analysis, the residual silver in the photosensitive material after processing was measured and the fixing solution was observed to be turbid. The results are shown in Table 3.

Under condition No. II-1, after 1 week's running without addition of additives according to the present invention, turbidity occurred in the fixing solution and there was also production of some yellow floating matter in which analysis showed to be sulfur.

It is seen that both the aminopolycarboxylic acids (condition Nos. II-2 and II-3) and the organic phosphonic acids (condition Nos. II-4 to II-7) disclosed in the present invention act to prevent deterioration of fixing solutions and that organic phosphonic acids give better effects than aminopolycarboxylic acids.

TABLE 3

| Condition No. | Additives to Fixing Solution | At the Start of Processing: Amount of Residual Silver ($\mu g/cm^2$) | At the Start of Processing: Fixing Solution Turbidity | After Processing for 1 Week Running: Amount of Residual Silver ($\mu g/cm^2$) | After Processing for 1 Week Running: Fixing Solution Turbidity |
|---|---|---|---|---|---|
| II-1 | None | 2.1 | None | 10 | Considerable turbidity |
| II-2 | Compound in this text A-(2) | 2.3 | None | 3.6 | Slight turbidity |
| II-3 | Compound in this text A-(5) | 2.1 | None | 3.5 | Slight turbidity |
| II-4 | Compound in this text B-(28) | 2.0 | None | 2.6 | No turbidity |
| II-5 | Compound in this text B-(68) | 1.9 | None | 2.3 | No turbidity |
| II-6 | Compound in this text B-(59) | 2.1 | None | 2.3 | No turbidity |
| II-7 | Compound in this text B-(57) | 2.0 | None | 2.1 | No turbidity |

EXAMPLE 3

Sample 301 in the form of multilayer color photosensitive material was prepared by multilayer coating of layers with the compositions noted below onto an undercoated cellulose triacetate film support.

Compositions of Photosensitive Layers

Regarding the amount of respective components as coated, the silver halide and colloidal silver are represented by the units of $g/m^2$ as silver coated; the coupler, additives and gelatin are represented by the units of $g/m^2$; and the sensitizing dye is represented by the number of mols per mol of the silver halide in the same layer.

| Sample 301 | |
|---|---|
| 1st Layer: Antihalation Layer: | |
| Black Colloidal Silver | 0.18 |
| Gelatin | 1.40 |
| 2nd Layer: Interlayer: | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| 3rd Layer: 1st Red-Sensitive Emulsion Layer: | |
| Monodispersed Silver Iodobromide Emulsion (AgI content: 6 mol %, average grain diameter: 0.6 μm, grain diameter variation coefficient: 0.15 ) | 0.55 as silver |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-10 | 0.020 |
| Gelatin | 0.87 |
| 4th Layer: 2nd Red-Sensitive Emulsion Layer: | |
| Tabular Silver Iodobromide Emulsion (silver iodide content: mol %, average grain diameter: 0.7 μm, average aspect ratio: 5.5, average grain thickness: 0.2 μm) | 1.0 as silver |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.050 |
| EX-10 | 0.015 |
| Gelatin | 1.30 |
| 5th Layer: 3rd Red-Sensitive Emulsion Layer: | |
| Silver Iodobromide Emulsion | 1.60 as silver |

-continued

| Sample 301 | |
|---|---|
| (silver iodide content: 16 mol %, average grain diameter: 1.1 μm) | |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| 6th Layer: Interlayer: | |
| EX-5 | 0.040 |
| HBS-1 | 0.020 |
| Gelatin | 0.80 |
| 7th Layer: 1st Green-Sensitive Emulsion Layer: | |
| Tabular Silver Iodobromide Emulsion (silver iodide content: 6 mol %, average grain diameter: 0.6 μm, average aspect ratio: 6.0, average grain thickness: 0.15 μm) | 0.40 as silver |
| Sensitizing Dye V | $3.0 \times 10^{-4}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| 8th Layer: 2nd Green-Sensitive Emulsion Layer: | |
| Monodispersed Silver Iodobromide Emulsion (silver iodide content: 9 mol %, average grain diameter: 0.7 μm, grain diameter variation coefficient: 0.18) | 0.80 as silver |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| 9th Layer: 3rd Green-Sensitive Emulsion Layer: | |
| Silver Iodobromide Emulsion (silver iodide content: 12 mol %, average grain diameter: 1.0 μm) | 1.20 as silver |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |

-continued

| Sample 301 | |
|---|---|
| HBS-2 | 0.10 |
| Gelatin | 1.54 |
| 10th Layer: Yellow Filter Layer: | |
| Yellow Colloidal Silver | 0.05 as silver |
| EX-5 | 0.08 |
| HBS-1 | 0.03 |
| Gelatin | 0.95 |
| 11th Layer: 1st Blue-Sensitive Emulsion Layer: | |
| Tabular Silver Iodobromide Emulsion (silver iodide content: 6 mol %, average grain diameter: 0.6 μm, average aspect ratio: 5.7, average grain thickness: 0.15 μm) | 0.24 as silver |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| 12th Layer: 2nd Blue-Sensitive Emulsion Layer: | |
| Monodispersed Silver Iodobromide Emulsion (silver iodide content: 10 mol %, average grain diameter: 0.8 μm, grain diameter variation coefficient: 0.16) | 0.45 as silver |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| 13th Layer: 3rd Blue-Sensitive Emulsion Layer: | |
| Silver Iodobromide Emulsion (silver iodide content: 14 mol %, average grain diameter: 1.3 μm) | 0.77 as silver |
| Sensitizing Dye VIII | $2.2 \times 10^{-4}$ |
| EX-9 | 0.20 |
| HBS-1 | 0.07 |
| Gelatin | 0.69 |
| 14th Layer: 1st Protective Layer: | |
| Silver Iodobromide Emulsion (silver iodide content: 1 mol %, average grain diameter: 0.07 μm) | 0.5 as silver |
| U-4 | 0.11 |
| U-5 | 0.17 |
| HBS-1 | 0.05 |
| Gelatin | 1.00 |
| 15th Layer: 2nd Protective Layer: | |
| Polymethyl Methacrylate Grains (diameter: about 1.5 μm) | 0.54 |
| S-1 | 0.20 |
| Gelatin | 1.20 |

Each of the above layers additionally contains Gelatin Hardener H-1 and surfactants.

Below, the chemical structure formulae and chemical names of compounds used in the present invention are indicated.

EX-1

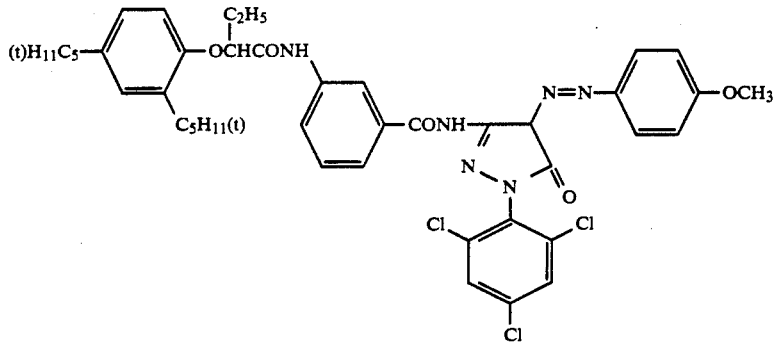

EX-2

-continued
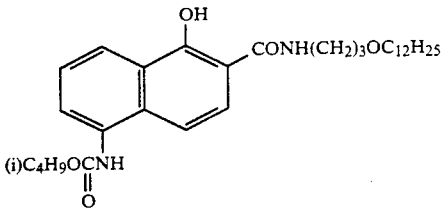
EX-3
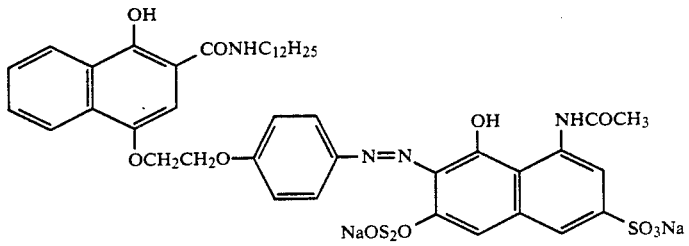
EX-4
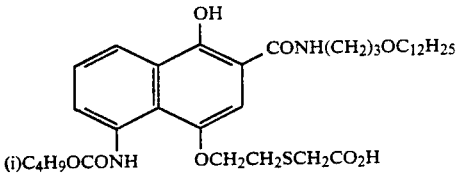
EX-5
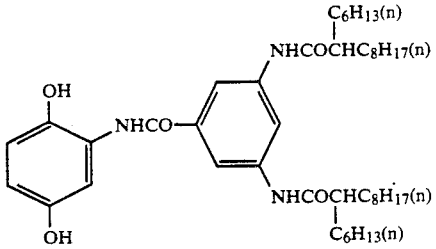
EX-6
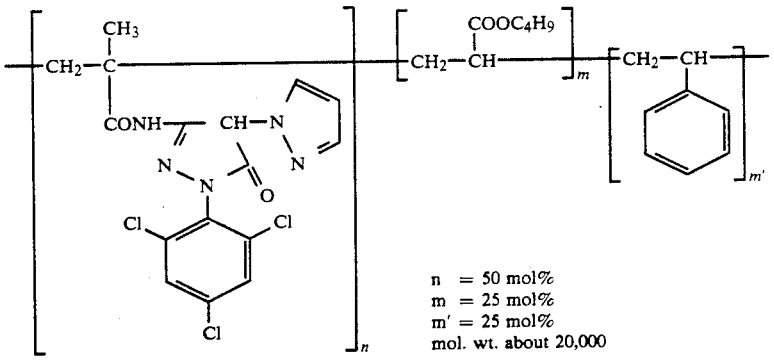
EX-7
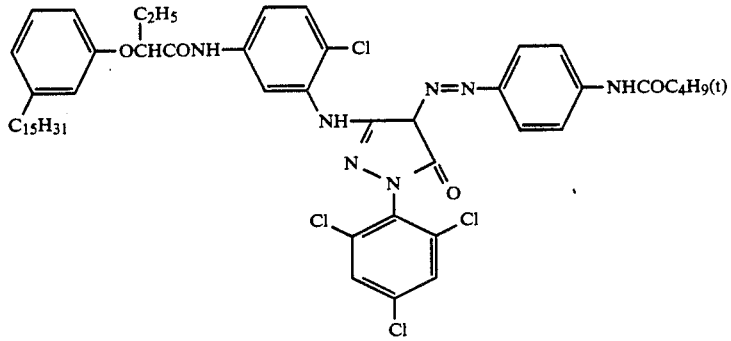
EX-8

-continued
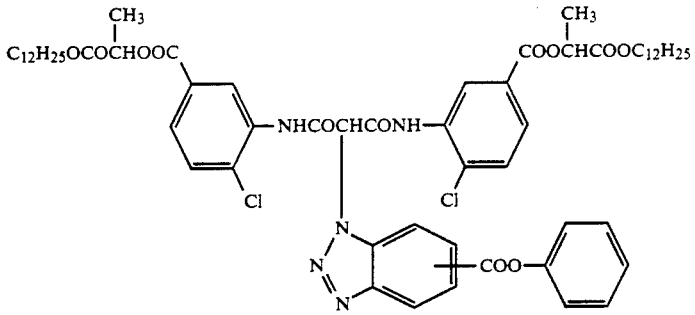
EX-9
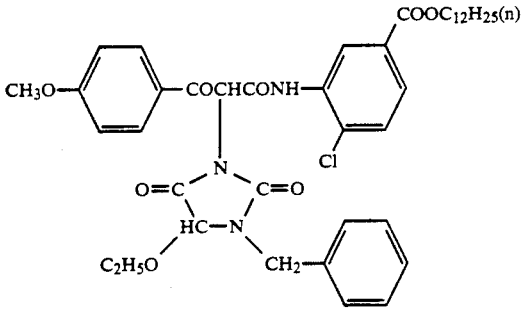
EX-10
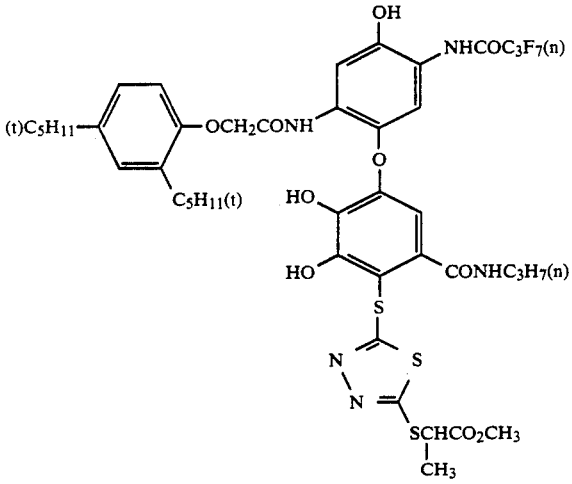
EX-11
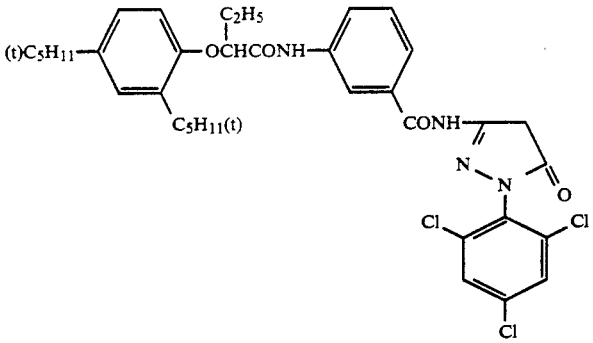
EX-12
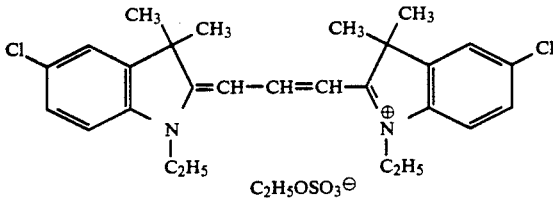
EX-13

-continued
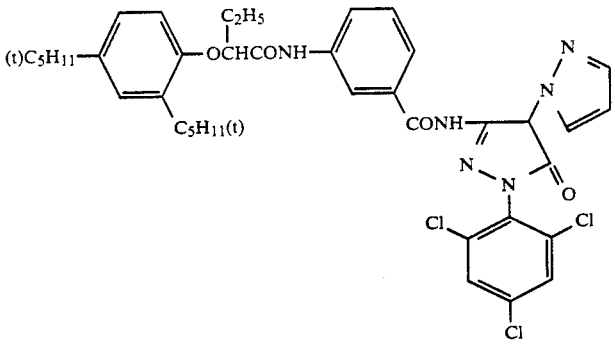
U-1
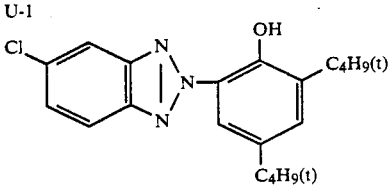
U-2
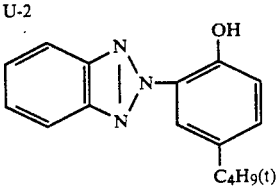
U-3
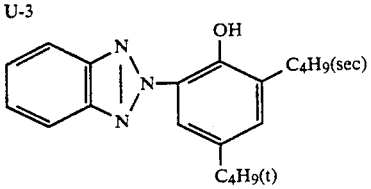
U-4
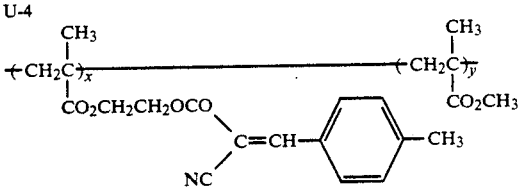
x/y = 70/30 (wt %)
UV-5
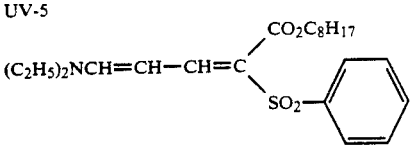
HBS-1 Tricresyl Phosphate
HBS-2 Di-n-butyl Phthalate
HBS-3
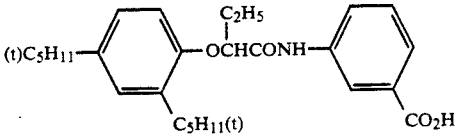
Sensitizing Dye I
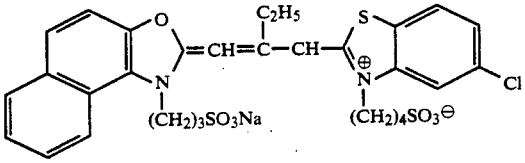
Sensitive Dye II
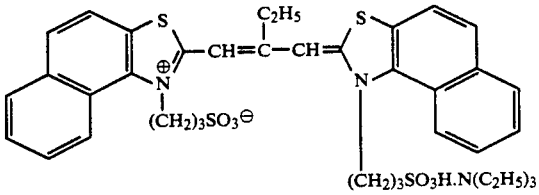
Sensitizing Dye III
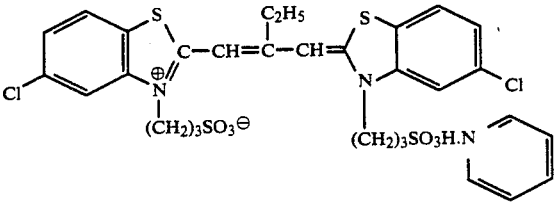
Sensitizing Dye V -continued

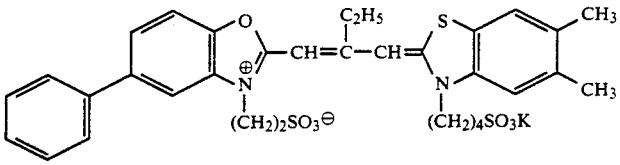

Sensitizing Dye VI

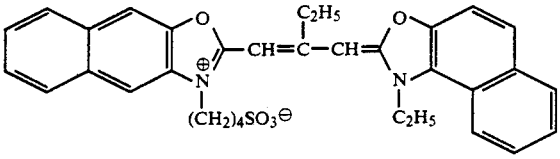

Sensitizing Dye VII

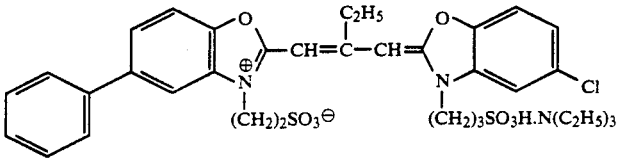

Sensitizing Dye VIII

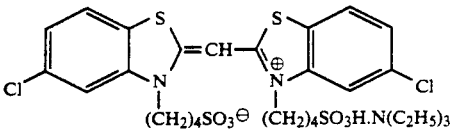

S-1

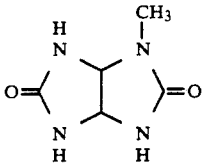

H-1

$CH_2{=}CH{-}SO_2{-}CH_2{-}CONH{-}CH_2$ $CH_2{=}CH{-}SO_2{-}CH_2{-}CONH{-}CH_2$

Except that the fixing solution had the composition as shown below, the development solution, bleaching solution and stabilization solution (stabilizing solution) were prepared with the same compositions as in Example 1.

| Fixing Solution | Mother Liquor | Replenisher |
|---|---|---|
| Compound Shown in Table 5 | See Table 5 | See Table 5 |
| Sodium Sulfite | 10.0 g | 12.0 g |
| Sodium Bisulfite | 8.0 g | 10.0 g |
| Ammonium Thiosulfate Aqueous Solution (700 g/liter) | 170.0 ml | 200.0 ml |
| Ammonium Rhodanate | 100.0 g | 150.0 g |
| Thiourea | 3.0 g | 5.0 g |
| 3,6-Dithia-1,8-octanediol | 3.0 g | 5.0 g |
| Water to make | 1.0 liter | 1.0 liter |
| pH (adjusted by addition of ammonium acetate) | 6.5 | 6.7 |

Processing was effected using the above photosensitive material and processing solutions and using the same processing machine as in Example 1.

In order to investigate changes due to storage in processing characteristics and deterioration of solutions, processing was effected at the rate of 15 m per day of sensitive material with 35 mm wide and the same running tests as in Example 1 were conducted at the start and after processing for 1 week running. These running tests were conducted using different amounts of a fixing solution replenisher.

Processing was carried out in an automatic developing machine using color photosensitive material and processing solutions prepared as indicated above. The processing steps were shown in Table 4 below.

TABLE 4

Processing Steps

| Processing Step | Processing Temperature (°C.) | Time | Replenishment Quantity* | Tank Capacity (l) |
|---|---|---|---|---|
| Color Development | 37.8 | 3 min 15 sec | 21 | 5 |
| Bleaching | 38.0 | 45 sec | 4.5 | 2 |
| Fixing (1) | 38.0 | 45 sec | (two-tank counter-current system) Noted in Table 5 | 2 |
| Fixing (2) | 38.0 | 45 sec | | 2 |

TABLE 4-continued

| Processing Step | Processing Temperature (°C.) | Time | Replenishment Quantity* | Tank Capacity (l) |
|---|---|---|---|---|
| | | Processing Steps | | |
| Stabilization (1) | 38.0 | 20 sec | (three-tank counter-current system) 35 | 1 |
| Stabilization (2) | 38.0 | 20 sec | | 1 |
| Stabilization (3) | 38.0 | 20 sec | | 1 |
| Drying | 55 | 1 min 00 sec | | |

*Replenishment quantity: per 1 m length of a photosensitive material with 35 mm wide

TABLE 5

| Condition No. | Remarks | Additives to Fixing Solution | Changes in desilvering performance and fixing solution after 1 week's running: Fixing Solution Replenishment Quantity: Residual Silver | Fixing Solution Replenishment Quantity: Fixing Solution Turbidity | Fixing Solution Replenishment Quantity (30 ml): Residual Silver | Fixing Solution Replenishment Quantity (30 ml): Fixing Solution Turbidity | Fixing Solution Replenishment Quantity (15 ml): Residual Silver | Fixing Solution Replenishment Quantity (15 ml): Fixing Solution Turbidity |
|---|---|---|---|---|---|---|---|---|
| III-1 | Invention | 1-Hydroxyethylidene-1,1-diphosphonic acid 5 g/liter Ethylenediaminetetraacetic acid 0.5 g/liter | 4 μg/cm² | None | 4 μg/cm² | None | 5 μg/cm² | None |
| III-2 | Comparison | None | 6 μg/cm² | Slight turbidity | 10 μg/cm² | Turbidity | 30 μg/cm² | Extreme Turbidity |

As is apparent from the results in Table 5, by addition of compounds according to the present invention to the fixing solution, little occurrence of fixing solution turbidity and little occurrence of poor desilvering (poor fixing) were found even if after running for 1 week. In contrast, there were the problems of marked fixing solution turbidity and an increase in residual silver on films in the case of fixing solutions which were used for comparison and did not contain the compounds of the present invention.

Table 5 shows that the present invention has the advantage that it is particularly effective in reducing the amount of fixing solution replenisher.

EXAMPLE 4

The same photographic material 101 prepared in Example 1 was processed by the following desilvering steps (i.e., the Bleaching→Bleach-Fixing→Fixing Step). Then, the stability of the processing solution after a running processing was examined.

The results are shown below.

TABLE 5

| Bleaching Solutions (A) to (F) | Mother Liquor | Replenisher |
|---|---|---|
| Bleaching Agent (see Table 7) | See Table 7 | See Table 7 |
| Ammonium Bromide | 85 g | 120 g |
| Ammonium Nitrate | 17.5 g | 25 g |
| Acetic Acid | 100 g | 143 g |
| Water to make | 1.0 liter | 1.0 liter |
| pH | See Table 7 | See Table 7 |
| Bleach-Fixing Solution | | |
| The bleaching solution described above | | 132 ml |
| The fixing solution described below | | 887 ml |

| Fixing Solution: | Mother Liquor | Replenisher |
|---|---|---|
| Ammonium Thiosulfate Aqueous | 280 ml | 336 ml |

TABLE 6

| Step | Processing Temperature (°C.) | Time | Replenishment* Quantity | |
|---|---|---|---|---|
| | | Processing Steps | | |
| Color Development | 38 | 3 min 05 sec | 23 ml | |
| Bleaching | 38 | 30 sec | 5 ml | Overflow |
| Bleach-Fixing | 38 | 45 sec | | Overflow |
| Fixing | 38 | 45 sec | 50 ml | |
| Stabilization (1) | 38 | 30 sec | | Overflow |
| Stabilization (2) | 38 | 20 sec | | Overflow |
| Stabilization (3) | 38 | 20 sec | 35 ml | |
| Drying | 60 | 1 min 00 sec | | |

*Replenishment quantity is per 1 m length of photosensitive material with 35 mm wide.

-continued

| Fixing Solution: | Mother Liquor | Replenisher |
|---|---|---|
| Solution (700 g/liter) | | |
| Ammonium Sulfite | 19 g | 22.8 g |
| Compound as described in Table 8 | See Table 8 | See Table 8 |
| Sodium Hydrogenphosphate | 20 g | 24 g |
| pH | 7.4 | 7.5 |

After color development, the same stabilizing solution as in Example 2 was used.

TABLE 7

| | Bleaching Agent | Content of Bleaching Agent in Mother Liquor (mol/liter) | Content of Bleaching Agent in Replenisher (mol/liter) | pH of Mother Liquor | pH of Mother Liquor |
|---|---|---|---|---|---|
| Bleaching Solution A | Ammonium (ethylenediaminetetraacetato) iron (III) | 0.35 | 0.50 | 6.0 | 4.7 |
| Bleaching Solution B | Ammonium (1,3-diaminopropanetetraacetato) iron (III) | 0.10 | 0.14 | 6.0 | 4.7 |
| Bleaching Solution C | Ammonium (1,3-diaminopropanetetraacetato) iron (III) | 0.35 | 0.50 | 6.0 | 4.7 |
| Bleaching Solution D | Ammonium (1,3-diaminopropanetetraacetato) iron (III) | 0.35 | 0.50 | 3.8 | 3.0 |
| Bleaching Solution E | Ammonium (1,3-diaminopropanetetraacetato) iron (III) | 0.35 | 0.50 | 3.0 | 2.5 |
| Bleaching Solution F | Ammonium (1,3-diaminopropanetetraacetato) iron (III) | 0.35 | 0.50 | 2.0 | 1.5 |

TABLE 7-continued

The above photographic material 101 was processed using the processing solution as described above by the automatic developing machine in which the ditch was equipped for overflowing between the bleaching tank and the bleach-fixing tank, and the fixing tank and the bleach-fixing tank, thereby the liquid surface of the bleach-fixing bath became lower than that of the bleaching bath and the fixing bath, and therefore the liquid composition of the bleach-fixing solution was maintained by the overflowing in which the overflowing bleaching solution and the overflowing fixing solution were carried out into the bleach-fixing tank.

The processing was effected at a rate of 30 m per day of photographic material with 35 mm wide, and turbidity occurred in the bleach-fixing solution after 1 week and 2 weeks was observed.

The results are shown in Table 8.

As is apparent from the results of Table 8, under the condition that a (1,3-diaminopropanetetraacetato)iron (III) salt which is a bleaching agent of the present invention is contained in an amount of 0.2 mol or more, and a pH is from 2.5 to 5.5, the fog is not observed and the sufficient desilvering is achieved. However, in order to retain the processing ability in the running processing, the compounds of the present invention is required to be added to the fixing solution.

That is, as is apparent from the results of Table 8, when the compounds are not added to the fixing solution, the turbidity is extremely generated in the fixing solution and the residual silver due to poor desilvering is increased. However, the stabilized rapid desilvering is achieved by adding the compounds and additives of the present invention even after running.

TABLE 8

| | | | | At the Start of Processing | | | After Processing for 1 Week Running | | |
|---|---|---|---|---|---|---|---|---|---|
| Condition No. | Remarks | Bleaching Solution | Additives to* Fixing Solution | Amount of Residual Silver ($\mu g/cm^2$) | Bleaching Fog ($\Delta D$) | Bleach-Fixing Turbidity | Amount of Residual Silver ($\mu g/cm^2$) | Bleaching Fog ($\Delta D$) | Bleach-** Fixing Turbidity |
| IV-1 | Comparison | Bleaching Solution (A) | None | 25 | 0.005 | None | 30 | 0.005 | None |
| IV-2 | " | Bleaching Solution (A) | 12.6 g/l of compound A-(1) in this text (15.1 g/liter)* | 25 | 0.005 | " | 31 | 0.005 | " |
| IV-3 | " | Bleaching Solution(B) | None | 5.2 | 0.008 | " | 6.1 | 0.11 | A |
| IV-4 | " | Bleaching Solution (C) | None | 2.0 | 0.13 | " | 7.2 | 0.15 | B |
| IV-5 | " | Bleaching Solution (C) | 12.6 g/l of compound A-(1) in this text (15.1 g/liter)* | 1.8 | 0.12 | " | 2.0 | 0.13 | None |
| IV-6 | " | Bleaching Solution (D) | None | 1.6 | 0.03 | " | 9.5 | 0.02 | C |
| IV-7 | Invention | Bleaching | 12.6 g/l of compound | 1.5 | 0.02 | " | 2.0 | 0.02 | None |

TABLE 8-continued

| Condition No. | Remarks | Bleaching Solution | Additives to* Fixing Solution | At the Start of Processing: Amount of Residual Silver ($\mu g/cm^2$) | At the Start of Processing: Bleaching Fog ($\Delta D$) | At the Start of Processing: Bleach-Fixing Turbidity | After Processing for 1 Week Running: Amount of Residual Silver ($\mu g/cm^2$) | After Processing for 1 Week Running: Bleaching Fog ($\Delta D$) | After Processing for 1 Week Running: Bleach-** Fixing Turbidity |
|---|---|---|---|---|---|---|---|---|---|
| | | Solution (D) | A-(1) in this text (15.1 g/liter)* | | | | | | |
| IV-8 | Comparison | Bleaching Solution (E) | None | 1.3 | 0.00 | " | 10.2 | 0.0 | D |
| IV-9 | Invention | Bleaching Solution (E) | 12.6 g/l of compound A-(1) in this text (15.1 g/liter)* | 1.3 | 0.00 | None | 1.8 | 0.0 | None |
| IV-10 | Comparison | Bleaching Solution (F) | None | 3.2 | 0.01 | " | 19.7 | 0.00 | E |
| IV-11 | " | Bleaching Solution (F) | 12.6 g/l of compound A-(1) in this text (15.1 g/liter)* | 3.3 | 0.00 | " | 9.2 | 0.00 | C |

*Amount of additives added to the replenisher
**Evaluation
A: Slight turbidity
B: Observable turbidity
D: Considerable turbidity
E: Extreme turbidity
C: Between B and D While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising the steps of:

(a) developing an imagewise exposed silver halide color photographic material, (b) processing the developed silver halide color photographic material with a bleaching bath, and (c) processing the bleached silver halide color photographic material with a bath having a fixing ability, wherein said beaching bath (i) contains (1) a (1,3-diaminopropantetraacetato)-iron (III) complex salt as a bleaching agent in an amount of 0.25 to 0.5 mol/liter of the bleaching bath and (2) an organic acid having a pKa of from 2.5 to 5.5 in an amount of 0.5 to 1.5 mol per liter of bleaching bath and (ii) has a pH of from 2.5 to 5.5, and said bath having a fixing ability contains at least one aminopolycarboxylic acid and an organic phosphoric acid in an amount of from $2\times10^{-3}$ to 0.2 mol per liter of the bath having a fixing ability provided that when the bath having a fixing ability is a bleach-fixing bath, the bath having a fixing ability contains an iron (III) complex salt of an aminopolycarboxylic acid represented by formula (I) as a bleaching agent:

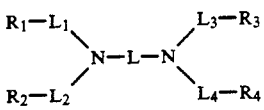

(I)

wherein

L represents an ethylene group, a cycloalkylene group, $-C_2H_4-O-C_2H_4-$ or $-C_2H_4-Z-C_2H_4-$;

Z represents

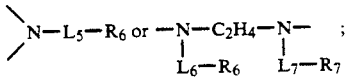

$L_1$ to $L_7$ each represents an alkylene group having 1 or 2 carbon atoms; and $R_1$ to $R_7$ each represents a hydrogen atom, a hydroxyl group, a carboxylic acid group or a salt thereof.

2. The method as in claim 1, wherein said aminopolycarboxylic acid is a compound represented by formula (I):

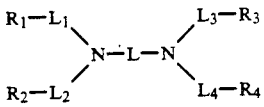

(I)

wherein

L represents an ethylene group, a cycloalkylene group, $-C_2H_4-O-C_2H_4-$ or $-C_2H_4-Z-C_2H_4-$;

Z represents

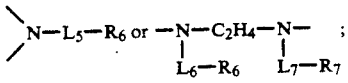

$L_1$ to $L_7$ each represents an alkylene group having 1 to 2 carbon atoms;

$R_1$ to $R_7$ each represents a hydrogen atom, a hydroxyl group, a carboxylic acid or a salt thereof; and the number of carboxylic acid groups contained in formula (I) is at least 3.

3. The method as in claim 1, wherein said organic phosphonic acid is a compound represented by formula (II) or (III):

$$B-A_1-Z_0-A_2-C \quad \text{(II)}$$

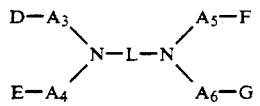

(III)

wherein $A_1$ to $A_6$ each represents a substituted alkylene group;

L represents an ethylene group, a cycloalkylene group, or $—C_2H_4—O—C_2H_4$ or $—C_2H_4—Z_0—C_2H_4—$;

$Z_0$ represents an alkylene group, a cyclohexylene group, a phenylene group, —R—O—R—, —ROROR—,

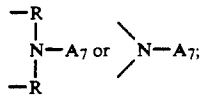

R represents an alkylene group;

$A_7$ is a hydrogen atom, a hydrocarbon group, a lower aliphatic carboxylic acid group or a lower alcohol group;

B, D, E, F and G each represents —OH, —COOM or $—PO_3M_2$;

M is a hydrogen atom, an alkali metal atom or an ammonium group; and at least one of B, C, D, E, F and G is $—PO_3M_2$.

4. The method as claimed in claim 1, wherein said organic phosphonic acid is represented by formula (IV) or (V):

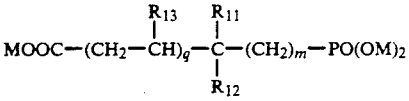

(IV)

wherein $R_{11}$ represents —COOM or $—PO(OM)_2$;

$R_{12}$ is a hydrogen atom, an alkyl group having 1 to 4 carbon atoms, $—(CH_2)_n—COOM$, or a phenyl group;

$R_{13}$ is a hydrogen atom or —COOM;

M is a hydrogen atom, an alkali metal atom or an ammonium group;

m is 0 or 1;

n is an integer of from 1 to 4;

q is 0 or 1; and wherein m is 0, $R_{11}$ is $—PO(OM)_2$; or $$R_{14}N(CH_2PO_3M_2)_2 \quad (V)$$

wherein $R_{14}$ is lower alkyl group, an aryl group, an aralkyl group, a nitrogen-containing 6-membered heterocyclic group which is unsubstituted or substituted by one or more of —OH, $—OR_{15}$, $—PO_3M_2$, $—CH_2PO_3M_2$, $—N(CH_2PO_3M_2)_2$, $—COOM_2$, $N(CH_2COOM)_2$;

$R_{15}$ represents an alkyl group having 1 to 4 carbon atoms; and

M represents an alkali metal atom, or an ammonium group.

5. The method as in claim 1, wherein said organic phosphonic acid is a compound represented by formula (VI)

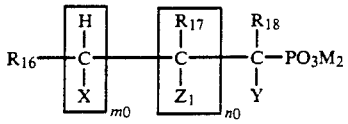

(VI)

wherein $R_{16}$ and $R_{17}$ each represents a hydrogen atom, a lower alkyl group, —COOH or $—NJ_2$;

J represents H, —OH, a lower alkyl group or $—C_2H_4OH$;

$R_{18}$ represents a hydrogen atom, a lower alkyl group, —OH, or $—NL'_2$;

L' is H, —OH, $—CH_3$, $—C_2H_5$, $—C_2H_4OH$ or $—PO_3M_2$;

X, Y, $Z_1$ represents —OH, —COOM, $—PO_3M_2$ or H;

M represents a hydrogen atom, an alkali metal atom, or an ammonium group;

n is 0 or an integer of 1 or more; and m is 0 or 1.

6. The method as in claim 1, wherein said organic phosphonic acid is a compound represented by formula (VII), (VIII), (IX) or (X):

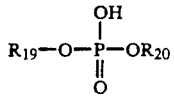

(VII)

wherein $R_{19}$ and $R_{20}$ each represents a hydrogen atom, an alkali metal group, an ammonium group, or a substituted or unsubstituted alkyl, alkenyl or cyclic alkyl group, each having up to 12 carbon atoms;

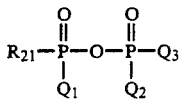

(VIII)

wherein $R_{21}$ represents an alkyl group having 1 to 12 carbon atoms, an alkoxy group having 1 to 12 carbon atoms, a monoalkylamino group having 1 to 12 carbon atoms, a dialkylamino group having 2 to 12 carbon atoms, an amino group, an allyloxy group having 2 to 24 carbon atoms, an arylamino group having 6 to 24 carbon atoms or an amyloxy group;

$Q_1$ to $Q_3$ each represents —OH, an alkoxy group having 1 to 24 carbon atoms, an aralkyloxy group having 7 to 24 carbon atoms, an allyloxy group having 2 to 24 carbon atoms, $—OM_3$, an amino group, a morpholino group, a cyclic amino group, an alkylamino group, a dialkylamino group, an arylamino group or an alkyloxy group;

M is a cation;

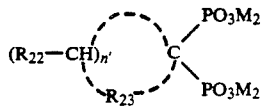

(IX)

wherein $R_{22}$ and $R_{23}$ each represents a hydrogen atom, a lower alkyl group, or an imino group, which may be substituted by a lower alkyl group or $—CH_2CH_2COONa$;

M represents a hydrogen atom, an alkali metal atom or an ammonium group;

n′ is an integer of from 2 to 16; and

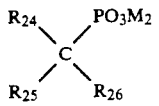

(X)

wherein $R_{24}$ to $R_{26}$ each independently represents a hydrogen atom or an alkyl group which may have substituents selected from —OH, $—OC_{n''}H_{2n''+1}$ where n″ is 1 to 4, $—PO_3M_2$, $—CH_2PO_3M$, and $—NR'_2$; and $—N(CH_2PO_3M_2)_2$;

R′ is an alkyl group; and

M represents a hydrogen atom, an alkali metal atom, or an ammonium group.

7. The method as in claim 1, wherein the amount of the at least one polycarboxylic acid and organic phosphonic acid in the bath having a fixing ability is $2\times10^{-3}$ mol is 0.2 mol per liter of the bath having a fixing ability.

8. The method as in claim 1, wherein the amount of the (1,3-diaminopropanetetraacetato)iron (III) complex salt in the bath having a bleaching ability is from 0.2 to 0.5 mol/liter.

9. The method as in claim 1, wherein said bath having a fixing ability is a fixing solution.

10. The method as in claim 1, wherein said bath having a fixing ability is a bleach-fixing solution.

11. The method as in claim 1, wherein said bleaching bath has a pH of from 2.5 to 4.5.

12. The method as in claim 1, wherein the amount of replenisher in said bath having a fixing ability is from 300 to 1000 ml per $m^2$ of the photographic material.

13. The method as in claim 1, wherein said organic acid having a pKa of from 2.5 to 5.5 is at least one acid selected from the group consisting of acetic acid, citric acid, malonic acid, benzoic acid, formic acid, butyric acid, malic acid, tartaric acid, oxalic acid, propionic acid and phthalic acid.

14. The method as in claim 1, wherein said organic acid having a pKa of from 2.5 to 5.5 is acetic acid.

15. The method as in claim 1, wherein said bleaching agent in the bleach-fixing bath is an iron (III) complex salt of ethylenediaminetetraacetic acid.

* * * * *